US010987948B2

(12) United States Patent
Ebisawa

(10) Patent No.: US 10,987,948 B2
(45) Date of Patent: Apr. 27, 2021

(54) INKJET PRINTER WITH EJECTION ADJUSTMENT FUNCTION BASED ON TEST PATTERN

(71) Applicant: RISO KAGAKU CORPORATION, Tokyo (JP)

(72) Inventor: Takashi Ebisawa, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/495,581

(22) PCT Filed: Mar. 19, 2018

(86) PCT No.: PCT/JP2018/010740
§ 371 (c)(1),
(2) Date: Sep. 19, 2019

(87) PCT Pub. No.: WO2018/180677
PCT Pub. Date: Oct. 4, 2018

(65) Prior Publication Data

US 2020/0238728 A1 Jul. 30, 2020

(30) Foreign Application Priority Data

Mar. 27, 2017 (JP) ..... JP2017-060564

(51) Int. Cl.
*B41J 3/54* (2006.01)
*B41J 2/155* (2006.01)
(Continued)

(52) U.S. Cl.
CPC ..... *B41J 3/543* (2013.01); *B41J 2/155* (2013.01); *B41J 2/2146* (2013.01); *B41J 2029/3935* (2013.01)

(58) Field of Classification Search
CPC ..... B41J 2/2146; B41J 29/393; B41J 2/2135; B41J 29/38; B41J 2/2132; B41J 2202/20;
(Continued)

(56) References Cited

U.S. PATENT DOCUMENTS

2003/0001914 A1 1/2003 Matsumoto et al.
2007/0296752 A1 12/2007 Maruo et al.
2014/0285828 A1 9/2014 Enge

FOREIGN PATENT DOCUMENTS

JP 09-123482 5/1997
JP 09123482 A * 5/1997
(Continued)

OTHER PUBLICATIONS

Official Communication issued in International Patent Application No. PCT/JP2018/010740, dated May 29, 2018, along with English Translation.

*Primary Examiner* — Jannelle M Lebron
(74) *Attorney, Agent, or Firm* — Greenblum & Bernstein, P.L.C.

(57) ABSTRACT

A controller performs control to: print a test pattern on a print medium, the test pattern including: a head reference straight line extending in a main scanning direction and printed by a reference print head; and head adjustment straight lines extending in the main scanning direction and printed by each of non-reference print heads at timings corresponding to timing adjustment values; and in response to input of information specifying the head adjustment straight line with a smallest print misalignment amount in the sub-scanning direction with respect to the head reference straight line for each of the non-reference print heads, determine, for each of the non-reference print heads, the timing adjustment value corresponding to the head adjustment straight line specified by the input information as an
(Continued)

adjustment value of an ink ejection timing in the non-reference print head in normal printing.

6 Claims, 22 Drawing Sheets

(51) Int. Cl.
*B41J 2/21* (2006.01)
*B41J 29/393* (2006.01)

(58) Field of Classification Search
CPC ..... B41J 2029/3935; B41J 2/04505; B41J 2/155; B41J 3/543
See application file for complete search history.

(56) References Cited

FOREIGN PATENT DOCUMENTS

| | | | |
|---|---|---|---|
| JP | 2002-079657 | | 3/2002 |
| JP | 2006-116845 | | 5/2006 |
| JP | 2006116845 A | * | 5/2006 |
| JP | 2008-001052 | | 1/2008 |
| JP | 2009-023310 | | 2/2009 |
| JP | 2009-066881 | | 4/2009 |
| JP | 2016-087956 | | 5/2016 |

* cited by examiner

INKJET PRINTER WITH EJECTION ADJUSTMENT FUNCTION BASED ON TEST PATTERN

TECHNICAL FIELD

The present invention relates to an inkjet printer which performs printing by ejecting ink from nozzles to a print medium.

BACKGROUND ART

In an inkjet printer including multiple print heads, when positions of nozzles are displaced from their proper positions due to attachment position misalignment of the print heads, print image quality decreases due to misalignment of ink landing positions. Accordingly, in a manufacturing process of the inkjet printer, position adjustment is performed to secure positional accuracy of the nozzles.

Specifically, the print heads first print a predetermined test pattern. In this test pattern, dots formed of ink ejected from the nozzles of the print heads are arranged in a predetermined pattern. After the printing of the test pattern, a print image of the test pattern is scanned by a scanner to generate image data. Next, this image data is analyzed to calculate positions of the dots and positional relationships among the nozzles in the print heads are obtained based on the calculated positions of the dots. Then, positions of the print heads are adjusted based on the obtained positional relationships among the nozzles in the print heads. Such adjustment of the positions of the print heads is performed also when a user replaces a print head at the user's site due to ejection failure or the like.

In such a case, the larger the inkjet printer is, the larger the scanner for scanning the print image of the aforementioned test pattern needs to be. Depending on the size of the inkjet printer, a scanner large enough to scan the image over the entire width of the print medium cannot be prepared in some cases. Accordingly, it is desirable to deal with the misalignment of the nozzles without using a scanner.

In this respect, Patent Literature 1 proposes a technique which can deal with misalignment of nozzles without scanning a test pattern with a scanner.

An inkjet printer of Patent Literature 1 includes multiple print head rows each including multiple print heads arranged in a main scanning direction while zigzagging. Here, the main scanning direction is a direction orthogonal to a conveyance direction (sub-scanning direction) of sheets. The multiple print head rows are arranged side by side in the sub-scanning direction. Each print head has multiple nozzles arranged in the main scanning direction and ejects ink from the nozzles.

The inkjet printer of Patent Literature 1 performs a registration operation of correcting correspondence relationships of the nozzles among the print head rows. In the registration operation, a test pattern is printed in which line segments extending in the sub-scanning direction and having the same length are formed at the same position in the sub-scanning direction, respectively by a first print head row and a second print head row. Multiple test patterns are printed while the nozzle used to print the line segment in the second print head row is shifted one by one with respect to the nozzle used to print the line segment in the first print head row.

An operator visually checks the printed multiple test patterns without using a scanner. The user determines the test pattern with the largest overlapping portion between the line segment printed by the first print head row and the line segment printed by the second print head row and inputs information specifying this test pattern into the inkjet printer.

When the correspondence relationship between the nozzle used in the first print head and the nozzle used in the second head row in the printing of the test pattern determined by the user is different from a preset correspondence relationship of the nozzles between the two print head rows, the correspondence relationship of the nozzles between the two print head rows is corrected. Specifically, the correspondence relationship of the nozzles between the first print head row and the second print head row is corrected from the preset correspondence relationship to the correspondence relationship of the nozzles used in the two print head rows in the printing of the test pattern determined by the user.

The correspondence relationship of the nozzles between the first print head row and each of the print head rows other than the second print head row are also corrected by the aforementioned registration operation.

The technique of Patent Literature 1 can thereby deal with the misalignment of the nozzles caused by the misalignment of the print head rows in the main scanning direction.

CITATION LIST

Patent Literature

Patent Literature 1: Japanese Patent Application Publication No. 2016-87956

SUMMARY OF INVENTION

In the technique of Patent Literature 1, the line segment printed by the first print head row and the line segment printed by the other print head row have the same length and are printed at the same position in the sub-scanning direction. Thus, it is sometimes difficult to determine the degree of overlapping of the two line segments with the naked eye depending on the degree of ink bleed or the like. Accordingly, the correspondence relationship of the nozzles between the print head rows is sometimes not properly corrected.

Moreover, in the technique of Patent Literature 1, misalignment between the print head rows in the sub-scanning direction and misalignment of the nozzles caused by misalignment between the print heads forming the print head rows are not adjusted. Accordingly, when there is such misalignment, the print image quality may decrease due to ink landing position misalignment caused by such misalignment.

Accordingly, the technique of Patent Literature 1 sometimes cannot sufficiently reduce the decrease in print image quality caused by the misalignment of the nozzles.

An object of the present invention is to provide an inkjet printer which can reduce a decrease in print image quality while avoiding use of a scanner for adjustment of misalignment of nozzles.

An inkjet printer in accordance with some embodiments includes: print heads arranged in zigzag in a main scanning direction, each of the print heads including nozzles arranged in the main scanning direction and configured to eject ink from the nozzles to a print medium conveyed in a sub-scanning direction orthogonal to the main scanning direction; and a controller configured to control the print heads. The controller is configured to: control the print heads to print a test pattern on the print medium, the test pattern including: a head reference straight line extending in the main scanning direction and printed by a reference print head of the print heads; and head adjustment straight lines extending in the main scanning direction and printed by each of non-reference print heads of the print heads other than the reference print head at timings corresponding to timing adjustment values; and in response to input of information specifying the head adjustment straight line with a smallest print misalignment amount in the sub-scanning direction with respect to the head reference straight line for each of the non-reference print heads, determine, for each of the non-reference print heads, the timing adjustment value corresponding to the head adjustment straight line specified by the input information as an adjustment value of an ink ejection timing in the non-reference print head in normal printing.

According to the aforementioned configuration, since the print heads are arranged in the main scanning direction, the head reference straight line and the head adjustment straight lines are printed such that at least portions thereof do not overlap one another in the main scanning direction. Moreover, the head adjustment straights lines printed by the different print heads may be printed such that at least portions thereof do not overlap one another in the main scanning direction.

Thus, a worker can easily visually check a print misalignment amount in the sub-scanning direction between the head reference straight line and each of the head adjustment straight lines without using a scanner. This can reduce occurrence of the case where improper values are set as the timing adjustment values in the non-reference print heads which are print heads other than the reference print head, without the use of the scanner. As a result, it is possible to reduce a decrease in print image quality while avoiding the use of the scanner for adjustment of the misalignment of the nozzles.

A first print head and a second print head adjacent to each other of the print heads may be arranged to partially overlap each other in the main scanning direction in an overlap region. The controller may be configured to: control the first print head and the second print head to print a first seam portion adjustment straight line extending in the main scanning direction on the print medium by using a specified number of the nozzles from an end of the first print head on a side of the overlap region and print a second seam portion adjustment straight line extending in the main scanning direction, at a same position as or a position shifted from the first seam portion adjustment straight line in the sub-scanning direction, on the print medium by using the specified number of the nozzles from an end of the second print head on a side of the overlap region; then, control the first print head and the second print head to repeat an operation a specified number of times while controlling the first print head and the second print head alternately to reduce a number of nozzles to be used by one from the side of the overlap region side each time, the operation being an operation in which the first print head prints the first seam portion adjustment straight line on the print medium and the second print head prints the second seam portion adjustment straight line at a same position as or a position shifted from the first seam portion adjustment straight line in the sub-scanning direction on the print medium; and in response to input of information specifying a combination of the first seam portion adjustment straight line and the second seam portion adjustment straight line which has no gap between the first seam portion adjustment straight line and the second seam portion adjustment straight line in the main scanning direction and which has a smallest overlapping portion between the first seam portion adjustment straight line and the second seam portion adjustment straight line among combinations of the first seam portion adjustment straight lines and the second seam portion adjustment straight lines corresponding to combinations of the nozzles used in the first print head and the second print head, determine the nozzles used in the first print head and the second print head in the overlap region in printing of the combination specified by the input information as nozzles to be used in the overlap region in the normal printing.

According to the aforementioned configuration, since the first seam portion adjustment straight line and the second seam portion adjustment straight line are shifted from each other in the sub-scanning direction, the worker can easily visually check the overlapping portion therebetween in the main scanning direction without using the scanner. This can reduce occurrence of the case where the nozzles to be used in the overlap region are improperly set, without the use of the scanner. As a result, it is possible to reduce the decrease in print image quality caused by the misalignment of the nozzles due to misalignment of the print heads in the main scanning direction. Thus, the decrease in the print image quality can be further reduced without the use of the scanner.

The inkjet printer may further include print bars arranged side by side in the sub-scanning direction, each of the print bars including the print heads arranged in zigzag in the main scanning direction. The controller may be configured to: control the print bars to print a test pattern on the print medium, the test pattern including: a print bar sub-scanning reference straight line extending in the main scanning direction and printed by a sub-scanning reference print bar of the print bars; and print bar sub-scanning adjustment straight lines extending in the main scanning direction and printed by each of sub-scanning non-reference print bars of the print bars other than the sub-scanning reference print bar at timings corresponding to timing adjustment values, at least portions of the print bar sub-scanning adjustment straight lines not overlapping the print bar sub-scanning reference straight line in the main scanning direction; and in response to input of information specifying the print bar sub-scanning adjustment straight line with a smallest print misalignment amount in the sub-scanning direction with respect to the print bar sub-scanning reference straight line for each of the sub-scanning non-reference print bars, determine, for each of the sub-scanning non-reference print bars, the timing adjustment value corresponding to the print bar sub-scanning adjustment straight line specified by the input information as the adjustment value of the ink ejection timing in the sub-scanning non-reference print bar in the normal printing.

According to the aforementioned configuration, the print bar sub-scanning reference straight line and the print bar sub-scanning adjustment straight lines are such that at least portions thereof do not overlap one another in the main scanning direction. Moreover, the print bar sub-scanning reference straight lines printed by the different print bars are such that at least portions thereof do not overlap one another in the main scanning direction. Accordingly, the worker can easily visually check the print misalignment amounts in the sub-scanning direction between the print bar sub-scanning reference straight line and the print bar sub-scanning adjustment straight lines without using the scanner. This can reduce occurrence of the case where an improper value is set as the timing adjustment value in each of the sub-scanning non-reference print bars which are print bars other than the sub-scanning reference print bar, without the use of the scanner. As a result, it is possible to reduce the decrease in print image quality caused by the misalignment of the nozzles due to misalignment of the print bar in the sub-scanning direction. Thus, the decrease in the print image quality can be further reduced without the use of the scanner.

The controller may be configured to: control the print bars to print position determination straight lines extending in the sub-scanning direction, respectively, on the print medium by using the nozzles located at a same position from one side in the main scanning direction in the print bars; in response to input of information specifying the position determination straight line printed nearest to the other side in the main scanning direction, set the print bar having printed the position determination straight line specified by the input information as a main scanning reference print bar; control the print bars to print a print bar main scanning reference straight line extending in the sub-scanning direction on the print medium by using a reference nozzle of the set main scanning reference print bar and to print print bar main scanning adjustment straight lines extending in the sub-scanning direction on the print medium by using the nozzles of main scanning non-reference print bars of the print bars other than the main scanning reference print bar, the nozzles located at a same position as the reference nozzle from the one side in the main scanning direction in the main scanning non-reference print bars, at least portion of each of the print bar main scanning adjustment straight lines not overlapping the print bar main scanning reference straight line in the sub-scanning direction; then, control the print bars to repeat an operation a specified number of times, while controlling each of the main scanning non-reference print bars to shift a nozzle to be used to print the print bar main scanning adjustment straight line to a next one on the other side in the main scanning direction each time, the operation being an operation in which the main scanning reference print bar prints the print bar main scanning reference straight line on the print medium by using the reference nozzle and each of the main scanning non-reference print bars prints the print bar main scanning adjustment straight line on the print medium with at least portion of the print bar main scanning adjustment straight line not overlapping the print bar main scanning reference straight line in the sub-scanning direction; and in response to input of information specifying the print bar main scanning adjustment straight line with a smallest print misalignment amount in the main scanning direction with respect to the print bar main scanning reference straight line for each of the main scanning non-reference print bars, determine, for each of the main scanning non-reference print bars, a correspondence relationship of the nozzles between the main scanning reference print bar and each of the main scanning non-reference print bars in the normal printing to be a relationship in which the nozzle used to print the print bar main scanning adjustment straight line specified by the input information and the reference nozzle of the main scanning reference print bar are in charge of a same pixel in the main scanning direction.

According to the aforementioned configuration, the print bar main scanning reference straight line and the print bar main scanning adjustment straight lines are such that at least portions thereof do not overlap one another in the sub-scanning direction. Moreover, the print bar main scanning adjustment straight lines printed by the different print bars are also such that at least portions thereof do not overlap one another in the sub-scanning direction. Accordingly, the worker can easily visually check the print misalignment amounts in the main scanning direction between the print bar main scanning reference straight line and the print bar main scanning adjustment straight lines. This can reduce occurrence of the case where the correspondence relationship of the nozzles in the print bars is improper, without the use of the scanner. As a result, it is possible to reduce the decrease in print image quality caused by the misalignment of the nozzles due to misalignment of the print bars in the main scanning direction. Thus, the decrease in the print image quality can be further reduced without the use of the scanner.

An inkjet printer in accordance with some embodiments includes: print heads arranged in zigzag in a main scanning direction, each of the print heads including nozzles arranged in the main scanning direction and configured to eject ink from the nozzles to a print medium conveyed in a sub-scanning direction orthogonal to the main scanning direction; and a controller configured to control the print heads. A first print head and a second print head adjacent to each other of the print heads are arranged to partially overlap each other in the main scanning direction in an overlap region. The controller is configured to: control the first print head and the second print head to print a first seam portion adjustment straight line extending in the main scanning direction on the print medium by using a specified number of the nozzles from an end of the first print head on a side of the overlap region and print a second seam portion adjustment straight line extending in the main scanning direction, at a same position as or a position shifted from the first seam portion adjustment straight line in the sub-scanning direction, on the print medium by using the specified number of the nozzles from an end of the second print head on a side of the overlap region; then, control the first print head and the second print head to repeat an operation a specified number of times while controlling the first print head and the second print head alternately to reduce a number of nozzles to be used by one from the side of the overlap region side each time, the operation being an operation in which the first print head prints the first seam portion adjustment straight line on the print medium and the second print head prints the second seam portion adjustment straight line at a same position as or a position shifted from the first seam portion adjustment straight line in the sub-scanning direction on the print medium; and in response to input of information specifying a combination of the first seam portion adjustment straight line and the second seam portion adjustment straight line which has no gap between the first seam portion adjustment straight line and the second seam portion adjustment straight line in the main scanning direction and which has a smallest overlapping portion between the first seam portion adjustment straight line and the second seam portion adjustment straight line among combinations of the first seam portion adjustment straight lines and the second seam portion adjustment straight lines corresponding to combinations of the nozzles used in the first print head and the second print head, determine the nozzles used in the first print head and the second print head in the overlap region in printing of the combination specified by the input information as nozzles to be used in the overlap region in normal printing.

According to the aforementioned configuration, since the first seam portion adjustment straight line and the second seam portion adjustment straight line are shifted from each other in the sub-scanning direction, the worker can easily visually check the overlapping portion therebetween in the main scanning direction without using the scanner. This can reduce occurrence of the case where the nozzles to be used in the overlap region are improperly set, without the use of the scanner. As a result, it is possible to reduce the decrease in print image quality while avoiding the use of the scanner for adjustment of the misalignment of the nozzles.

An inkjet printer in accordance with some embodiments includes: print bars arranged side by side in a sub-scanning direction orthogonal to a main scanning direction, each of the print bars including nozzles arranged in the main scanning direction and configured to eject ink from the nozzles to a print medium conveyed in the sub-scanning direction; and a controller configured to control the print bars. The controller is configured to: control the print bars to print a test pattern on the print medium, the test pattern including: a print bar sub-scanning reference straight line extending in the main scanning direction and printed by a sub-scanning reference print bar of the print bars; and print bar sub-scanning adjustment straight lines extending in the main scanning direction and printed by each of sub-scanning non-reference print bars other than the sub-scanning reference print bar at timings corresponding to timing adjustment values, at least portions of the print bar sub-scanning adjustment straight lines not overlapping the print bar sub-scanning reference straight line in the main scanning direction; and in response to input of information specifying the print bar sub-scanning adjustment straight line with a smallest print misalignment amount in the sub-scanning direction with respect to the print bar sub-scanning reference straight line for each of the sub-scanning non-reference print bars, determine, for each of the sub-scanning non-reference print bars, the timing adjustment value corresponding to the print bar sub-scanning adjustment straight line specified by the input information as the adjustment value of the ink ejection timing in the sub-scanning non-reference print bar in normal printing.

According to the aforementioned configuration, the print bar sub-scanning reference straight line and the print bar sub-scanning adjustment straight lines are such that at least portions thereof do not overlap one another in the main scanning direction. Moreover, the print bar sub-scanning reference straight lines printed by the different print bars are such that at least portions thereof do not overlap one another in the main scanning direction. Accordingly, the worker can easily visually check the print misalignment amounts in the sub-scanning direction between the print bar sub-scanning reference straight line and the print bar sub-scanning adjustment straight lines without using the scanner. This can reduce occurrence of the case where an improper value is set as the timing adjustment value in each of the sub-scanning non-reference print bars which are print bars other than the sub-scanning reference print bar, without the use of the scanner. As a result, it is possible to reduce the decrease in print image quality while avoiding the use of the scanner for adjustment of the misalignment of the nozzles.

An inkjet printer in accordance with some embodiments includes: print bars arranged side by side in a sub-scanning direction orthogonal to a main scanning direction, each of the print bars including nozzles arranged in the main scanning direction and configured to eject ink from the nozzles to a print medium conveyed in the sub-scanning direction; and a controller configured to control the print bars. The controller is configured to: control the print bars to print position determination straight lines extending in the sub-scanning direction, respectively, on the print medium by using the nozzles located at a same position from one side in the main scanning direction in the print bars; in response to input of information specifying the position determination straight line printed nearest to the other side in the main scanning direction, set the print bar having printed the position determination straight line specified by the input information as a main scanning reference print bar; control the print bars to print a print bar main scanning reference straight line extending in the sub-scanning direction on the print medium by using a reference nozzle of the set main scanning reference print bar and to print print bar main scanning adjustment straight lines extending in the sub-scanning direction on the print medium by using the nozzles of main scanning non-reference print bars of the print bars other than the main scanning reference print bar, the nozzles located at a same position as the reference nozzle from the one side in the main scanning direction in the main scanning non-reference print bars, at least portion of each of the print bar main scanning adjustment straight lines not overlapping the print bar main scanning reference straight line in the sub-scanning direction; then, control the print bars to repeat an operation a specified number of times, while controlling each of the main scanning non-reference print bars to shift a nozzle to be used to print the print bar main scanning adjustment straight line to a next one on the other side in the main scanning direction each time, the operation being an operation in which the main scanning reference print bar prints the print bar main scanning reference straight line on the print medium by using the reference nozzle and each of the main scanning non-reference print bars prints the print bar main scanning adjustment straight line on the print medium with at least portion of the print bar main scanning adjustment straight line not overlapping the print bar main scanning reference straight line in the sub-scanning direction; and in response to input of information specifying the print bar main scanning adjustment straight line with a smallest print misalignment amount in the main scanning direction with respect to the print bar main scanning reference straight line for each of the main scanning non-reference print bars, determine, for each of the main scanning non-reference print bars, a correspondence relationship of the nozzles between the main scanning reference print bar and each of the main scanning non-reference print bars in normal printing to be a relationship in which the nozzle used to print the print bar main scanning adjustment straight line specified by the input information and the reference nozzle of the main scanning reference print bar are in charge of a same pixel in the main scanning direction.

According to the aforementioned configuration, the print bar main scanning reference straight line and the print bar main scanning adjustment straight lines are such that at least portions thereof do not overlap one another in the sub-scanning direction. Moreover, the print bar main scanning adjustment straight lines printed by the different print bars are also such that at least portions thereof do not overlap one another in the sub-scanning direction. Accordingly, the worker can easily visually check the print misalignment amounts in the main scanning direction between the print bar main scanning reference straight line and the print bar main scanning adjustment straight lines without using the scanner. This can reduce occurrence of the case where the correspondence relationship of the nozzles in the print bars is improper, without the use of the scanner. As a result, it is possible to reduce the decrease in print image quality while avoiding the use of the scanner for adjustment of the misalignment of the nozzles.

DESCRIPTION OF EMBODIMENTS

Figure 1:
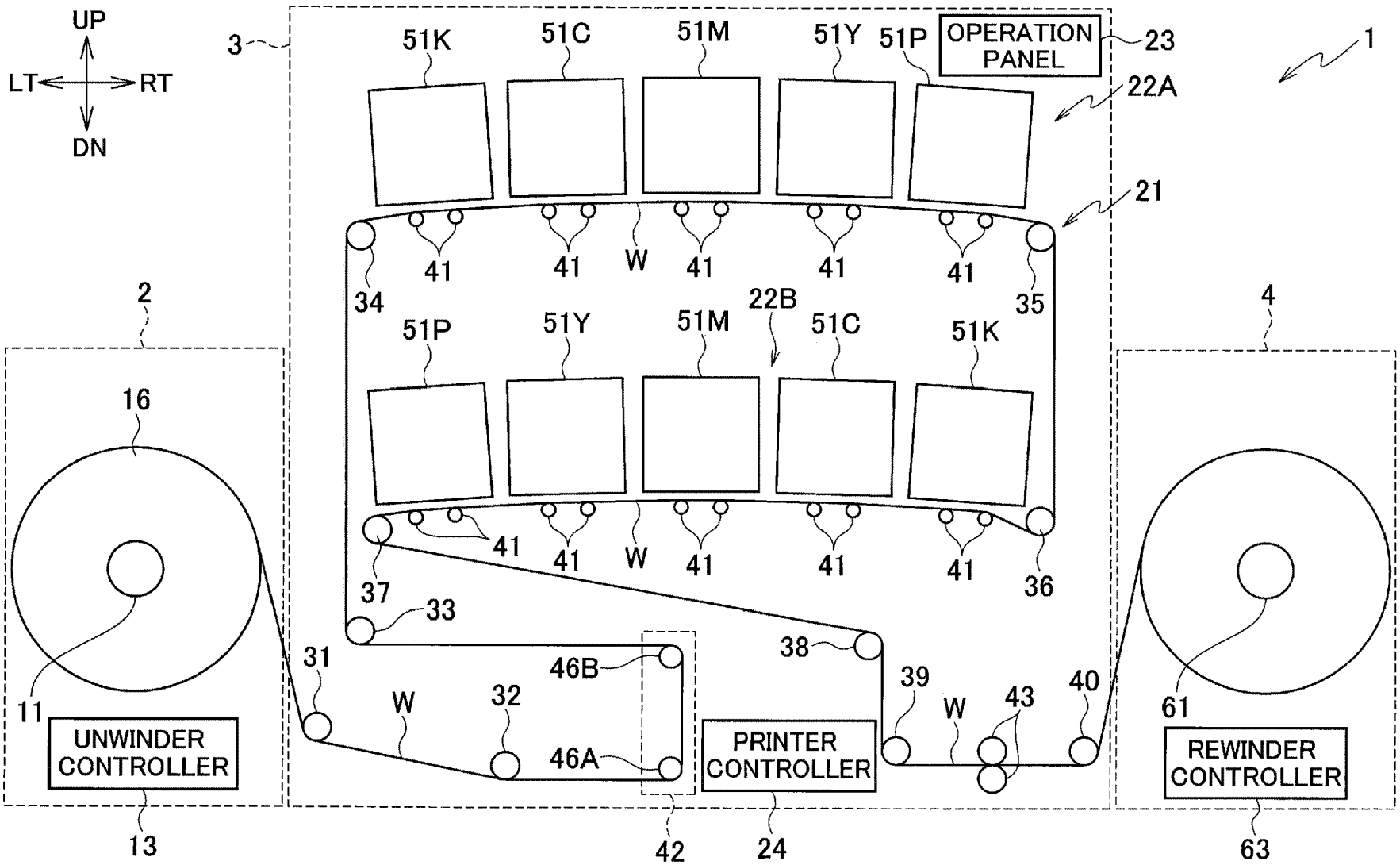
FIG. 1 is a schematic configuration diagram of a print system including an inkjet printer according to an embodiment.

Embodiments of the present invention are described below with reference to the drawings. The same or similar parts and components in the drawings are denoted by the same or similar reference numerals.

The embodiments described below are examples of device and the like for embodying the technical idea of the present invention. The technical idea of the present invention does not specify the materials, shapes, structures, arrangements, and the like of the components to those described below. Various changes can be added to the technical idea of the present invention within the scope of claims.

Figure 2:
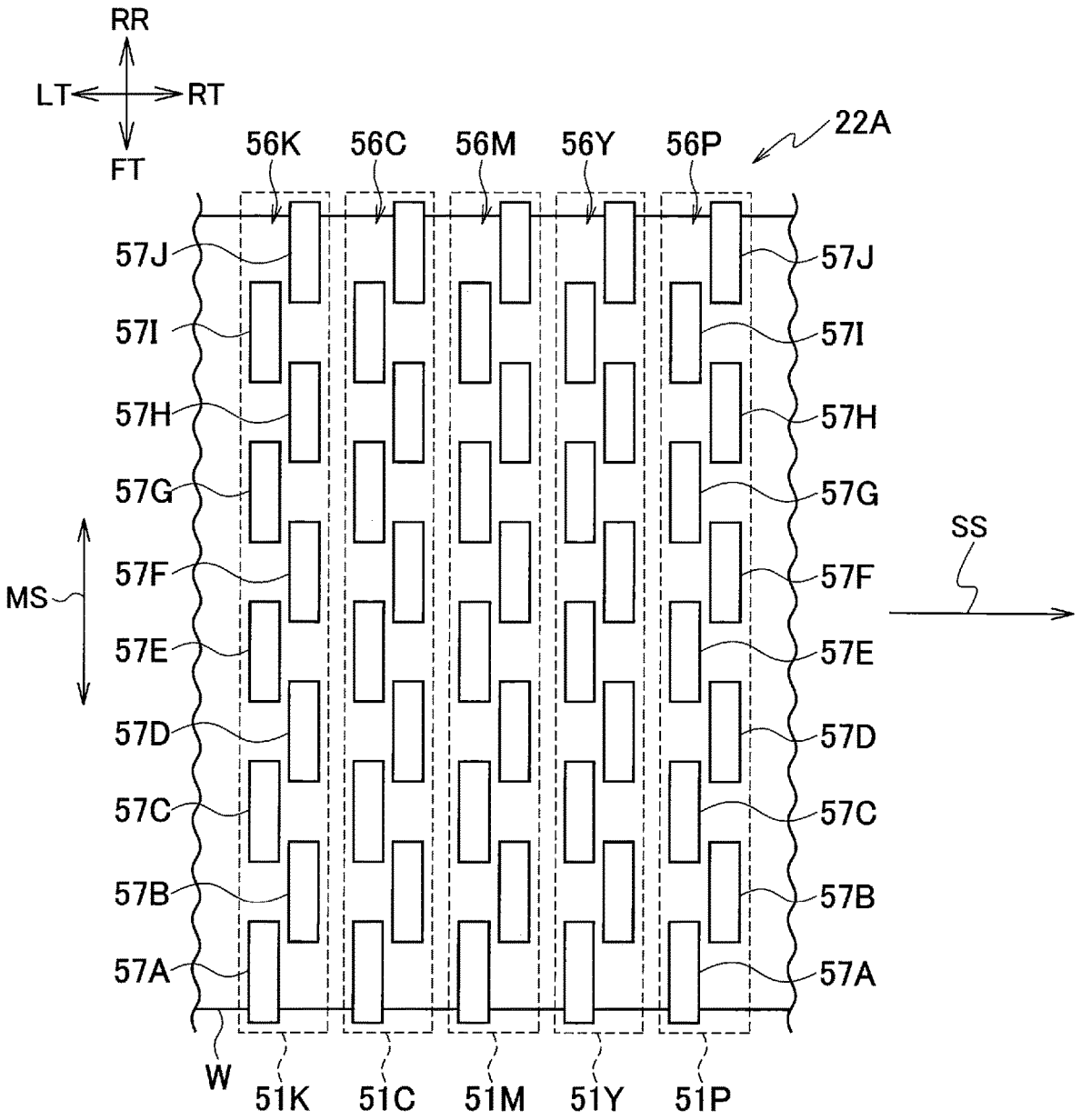
FIG. 2 is a plan view of a printer in the inkjet printer of the print system illustrated in FIG. 1.
Figure 3:
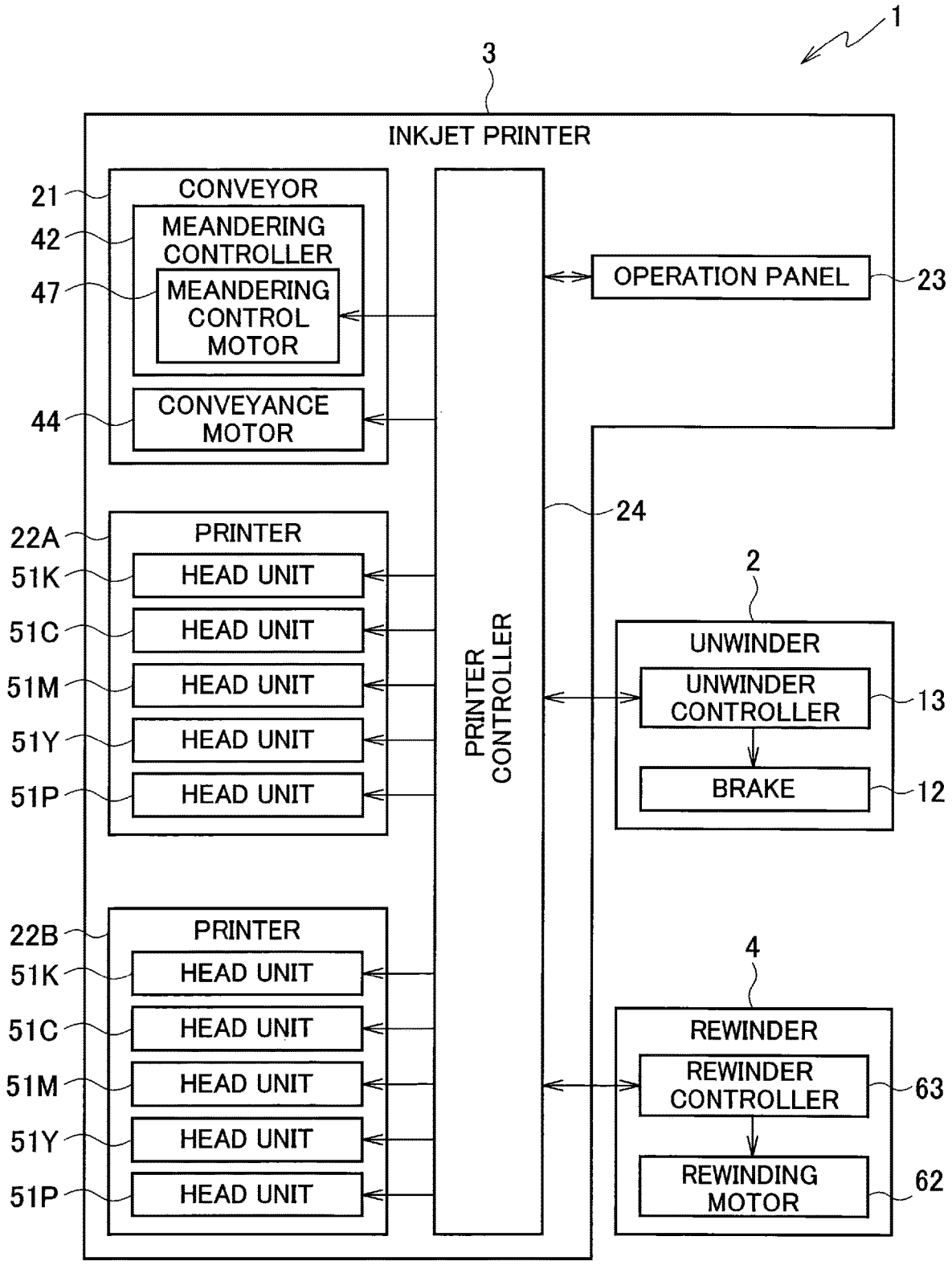
FIG. 3 is a control block diagram of the print system illustrated in FIG. 1.

FIG. 1 is a schematic configuration view of a print system 1 including an inkjet printer 3 according to an embodiment of the present invention. FIG. 2 is a plan view of a printer 22A in the inkjet printer 3 of the print system 1 illustrated in FIG. 1. FIG. 3 is a control block diagram of the print system 1 illustrated in FIG. 1. Note that, in the following description, a direction orthogonal to the sheet surface of FIG. 1 is referred to as front-rear direction and a direction from the sheet surface toward the viewer is referred to as front. Moreover, up, down, left, and right in the sheet surface of FIG. 1 are referred to as directions of up, down, left, and right. In FIGS. 1, 2, and 5 to 28, directions of right, left, up, down, front, rear, main scanning direction, and sub-scanning direction are denoted by RT, LT, UP, DN, FT, RR, MS, and SS, respectively.

As illustrated in FIGS. 1 and 3, the print system 1 according to the embodiment includes an unwinder 2, the inkjet printer 3, and a rewinder 4.

The unwinder 2 unwinds a web W being a long print medium made of film, paper, or the like to the inkjet printer 3. The unwinder 2 includes a web roll support shaft 11, a brake 12, and an unwinder controller 13.

The web roll support shaft 11 rotatably supports a web roll 16. The web roll support shaft 11 is formed in a long shape extending in the front-rear direction. The web roll 16 is the web W wound into a roll.

The brake 12 applies brake to the web roll support shaft 11. Tension is thereby applied to the web W between the web roll 16 and a pair of conveyance rollers 43 of the inkjet printer 3 to be described later.

The unwinder controller 13 controls the brake 12. The unwinder controller 13 includes a CPU, a RAM, a ROM, a hard disk drive, and the like.

The inkjet printer 3 prints images on the web W while conveying the web W unwound from the unwinder 2. The inkjet printer 3 includes a conveyor 21, printers 22A, 22B, an operation panel 23, and a printer controller (controller) 24. Note that the printers 22A, 22B and the like are sometimes collectively referred to by omitting the alphabets attached to the reference numerals.

The conveyor 21 conveys the web W unwound from the unwinder 2. The conveyor 21 includes guide rollers 31 to 40, 20 under-head support members 41, a meandering controller 42, the pair of conveyance rollers 43, and a conveyance motor 44.

The guide rollers 31 to 40 guide the web W conveyed in the inkjet printer 3. The guide rollers 31 to 40 rotate by following the web W being conveyed. The guide rollers 31 to 40 are each formed in a long shape extending in the front-rear direction.

The guide rollers 31, 32 guide the web W between the unwinder 2 and the meandering controller 42. The guide roller 31 is arranged in a left end portion of a lower portion of the inkjet printer 3. The guide roller 32 is arranged between the guide roller 31 and a meandering control roller 46A of the meandering controller 42 to be described later.

The guide rollers 33 to 39 guide the web W between the meandering controller 42 and the pair of the conveyance rollers 43. The guide roller 33 is arranged on the left side of a meandering control roller 46B of the meandering controller 42 to be described later. The guide roller 34 is arranged above the guide roller 33. The guide roller 35 is arranged on the right side of the guide roller 34 at substantially the same height as the guide roller 34. The guide roller 36 is arranged below the guide roller 35 and above the guide roller 33. The guide roller 37 is arranged on the left side of the guide roller 36, near and on the right side of the web W between the guide rollers 33, 34, at substantially the same height as the guide roller 36. The guide roller 38 is arranged on the lower right side of the guide roller 37. The guide roller 39 is arranged below and slightly on the right side of the guide roller 38.

The guide roller 40 guides the web W between the pair of conveyance rollers 43 and the rewinder 4. The guide roller 40 is arranged in a right end portion of the lower portion of the inkjet printer 3.

The under-head support members 41 support the web W below later-described head units 51 between the guide rollers 34, 35 and between the guide rollers 36, 37. The under-head support members 41 are each formed in a long shape extending in the front-rear direction. Ten under-head support members 41 are arranged in each of an area between the guide rollers 34, 35 and an area between the guide rollers 36, 37. Moreover, two under-head support members 41 are arranged directly below each head unit 51. The ten under-head support members 41 in each of the area between the guide rollers 34, 35 and the area between the guide rollers 36, 37 are arranged such that the web W is conveyed in an arch shape protruding upward.

The meandering controller 42 corrects meandering of the web W. The meandering controller 42 includes the meandering control rollers 46A, 46B and a meandering control motor 47.

The meandering control rollers 46A, 46B are rollers for guiding the web W and correcting the meandering of the web W. The meandering control rollers 46A, 46B are each formed in a long shape extending in the front-rear direction. The meandering control rollers 46A, 46B are each configured such that an angle of an axial direction thereof with respect to the width direction of the web W (front-rear direction) is adjustable. The meandering control roller 46A is arranged on the right side of the guide roller 32. The meandering control roller 46B is arranged above the meandering control roller 46A.

The meandering control motor 47 turns the meandering control rollers 46A, 46B about axes parallel to the left-right direction to adjust the angles of the axial directions of the meandering control rollers 46A, 46B with respect to the width direction of the web W (front-rear direction).

The pair of conveyance rollers 43 conveys the web W toward the rewinder 4 while nipping the web W. The conveyance rollers 43 are each formed in a long shape extending in the front-rear direction. The pair of conveyance rollers 43 is arranged between the guide rollers 39, 40.

The conveyance motor 44 rotationally drives the conveyance rollers 43.

The printer 22A prints images on a front side of the web W. The printer 22A is arranged above and near the web W between guide rollers 34, 35. As illustrated in FIGS. 1 and 2, the printer 22A includes head units 51K, 51C, 51M, 51Y, 51P.

The head units 51K, 51C, 51M, 51Y, 51P are arranged side by side in the left-right direction (sub-scanning direction). The head units 51K, 51C, 51M, 51Y, 51P include print bars 56K, 56C, 56M, 56Y, 56P, respectively. The print bars 56K, 56C, 56M, 56Y, 56P eject inks of black (K), cyan (C), magenta (M), yellow (Y), and an extra ink color, respectively. Red, light cyan, or the like is used as the extra ink color. The print bars 56K, 56C, 56M, 56Y, 56P have the same configuration except for the point that the colors of inks to be ejected are different. The print bars 56K, 56C, 56M, 56Y, 56P each include print heads 57A to 57J.

Each print head 57 includes multiple nozzles 58 (see FIG. 5 and the like) which are opened on an ink ejection surface facing the web W and which are arranged in the main scanning direction (front-rear direction), and ejects the ink from the nozzles 58.

The print heads 57 are arranged in zigzag in the main scanning direction (front-rear direction) in each print bar 56. Specifically, for example, in each print bar 56, ten print heads 57 (print heads 57A to 57J) are aligned in the main scanning direction with the position of every other print head 57 shifted in the sub-scanning direction (left-right direction) which is the conveyance direction of the web W. Moreover, the print heads 57 are arranged such that there are portions where the adjacent print heads 57 overlap each other in the main scanning direction. Note that the number of the print heads 57 is not limited to ten and may be any number.

The printer 22B prints images on a back side of the web W. The printer 22B is arranged above and near the web W between guide rollers 36, 37. The printer 22B includes head units 51K, 51C, 51M, 51Y, 51P like the printer 22A.

The configuration of the printer 22B is right-left reversed to the configuration of the printer 22A. This is because the conveyance direction of the web W between the guide rollers 36, 37 in which the printer 22B performs printing is opposite to that between the guide rollers 34, 35 in which the printer 22A performs printing. The configuration of the printer 22B is the same as that of the printer 22A other than being right-left reversed.

The operation panel 23 displays various input screens and the like and receives input operations made by a user. The operation panel 23 includes a display unit having a liquid crystal display panel and the like and an input unit having various operation keys, a touch panel, and the like (both units are not illustrated).

The printer controller 24 controls operations of various parts of the inkjet printer 3. The printer controller 24 includes units such as a CPU, a RAM, a ROM, a hard disk drive, and a storage formed of a semiconductor memory or the like. The storage stores instructions which cause a processor such as the CPU to perform processing to be described below when executed by the processor.

In a print adjustment operation dealing with misalignment of the nozzles 58, the printer controller 24 executes print head sub-scanning adjustment processing, seam portion adjustment processing, print bar sub-scanning adjustment processing, and print bar main scanning adjustment processing to be described later.

The rewinder 4 rewinds the web W subjected to printing in the inkjet printer 3. The rewinder 4 includes a rewinding shaft 61, a rewinding motor 62, and a rewinder controller 63.

The rewinding shaft 61 rewinds and holds the web W. The rewinding shaft 61 is formed in a long shape extending in the front-rear direction.

The rewinding motor 62 rotates the rewinding shaft 61 clockwise in FIG. 1. Rotation of the rewinding shaft 61 causes the web W to be rewound on the rewinding shaft 61.

The rewinder controller 63 controls drive of the rewinding motor 62. The rewinder controller 63 includes a CPU, a RAM, a ROM, a hard disk drive, and the like.

Next, the print adjustment operation in the inkjet printer 3 is described.

The print adjustment operation is an operation of performing various adjustments to deal with misalignment of the nozzles 58 caused by misalignment in attachment positions of the print bars 56 and the print heads 57 in the printers 22.

Figure 4:
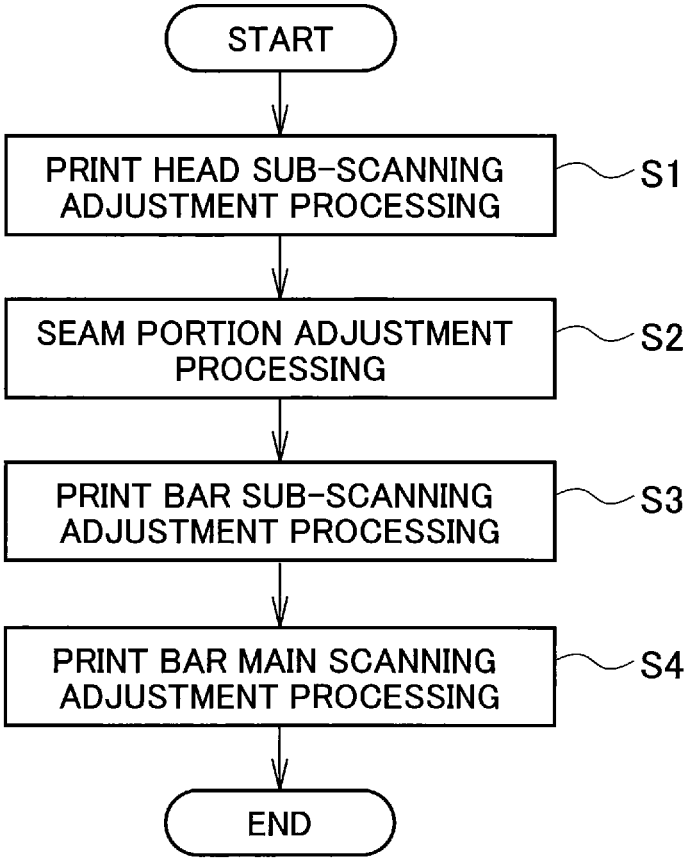
FIG. 4 is a flowchart for explaining a print adjustment operation.

FIG. 4 is a flowchart for explaining the print adjustment operation in the inkjet printer 3. The print adjustment operation is executed, for example, when a service person installs the print bar 56 in the inkjet printer 3 at a user's site or when ink ejection failure or the like occurs and a user replaces the print bar 56. The print adjustment operation is performed for each of the printers 22A, 22B.

First, in step S1 of FIG. 4, the printer controller 24 executes the print head sub-scanning adjustment processing. The print head sub-scanning adjustment processing is processing of adjusting misalignment of the print heads 57 in the sub-scanning direction in each print bar 56.

Figure 5:
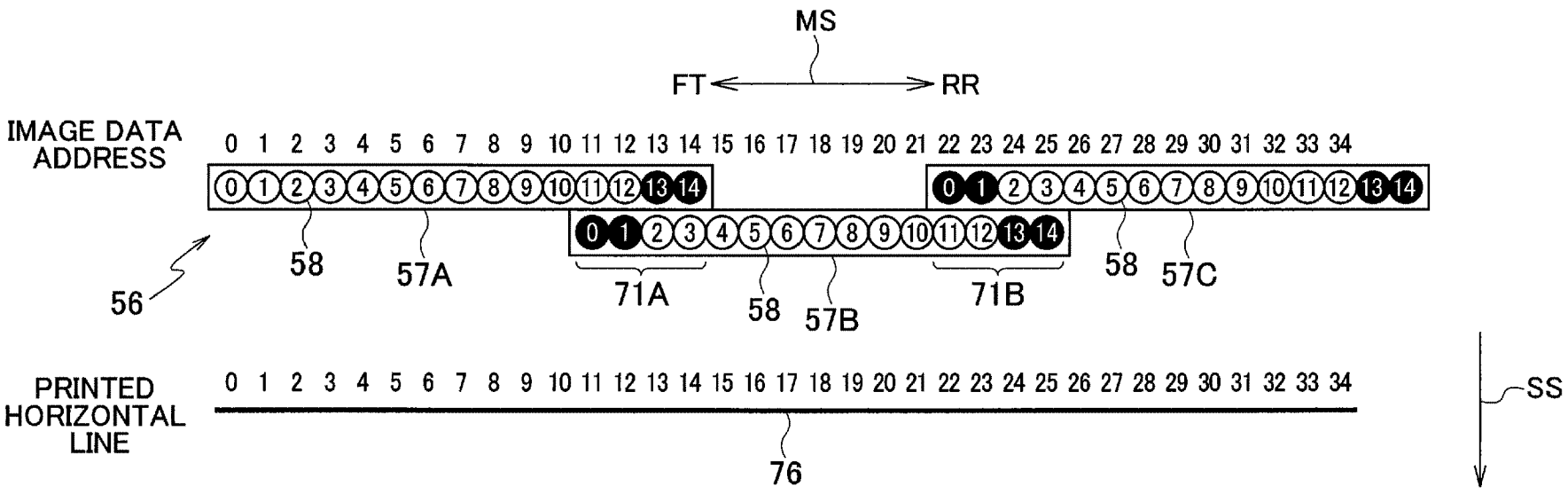
FIG. 5 is a schematic view illustrating a state where print heads in a print bar are not misaligned in a main scanning direction and a sub-scanning direction.

FIG. 5 schematically illustrates an ideal state where the print heads 57 are not misaligned in the main scanning direction and the sub-scanning direction in the print bar 56. In FIG. 5, a portion of the print bar 56 including the print heads 57A to 57C is extracted and illustrated. Moreover, the number of the nozzles 58 in each print head 57 is assumed to be 15. Furthermore, in each of overlap regions 71A, 71B between the print heads 57 adjacent to each other in the main scanning direction, four nozzles 58 of one print head 57 overlap four nozzles 58 of another print head 57. Moreover, in each overlap region 71, two nozzles 58 from an end of each print head 57 on the overlap region 71 side are set to be used in printing. Note that the number of the nozzles 58 in each print head 57 is not limited to 15 and may be any number.

Note that, in FIGS. 5 to 28, 30, and 37, the numbers in the circles representing the nozzles 58 indicate nozzle numbers N. The nozzles 58 whose nozzles numbers N are written in black on a white background are the nozzles 58 to be used in printing (nozzles to be used). Meanwhile, the nozzles 58 whose nozzles numbers N are written in white on a black background are the nozzles 58 not to be used in printing (nozzles not to be used). The ink is ejected from the nozzles 58 which are the nozzles to be used, based on data of address (image data address) corresponding to the nozzles 58 in image data.

A print head 57B downstream in the conveyance direction (sub-scanning direction) of the web W performs ink ejection for the same line in the main scanning direction at a later timing than upstream print heads 57A, 57C. Specifically, for example, when a horizontal line 76 which is a straight line extending in the main scanning direction is to be printed by the print heads 57A to 57C, the print head 57B performs the ink ejection at a timing later than the print heads 57A, 57C. The time from the ink ejection timing of the print head 57A, 57C to the ink ejection timing of the print head 57B for the same line in the main scanning direction is set depending on conveyance speed of the web W and an interval between the print heads 57A, 57C and the print head 57B in the sub-scanning direction.

Figure 6:
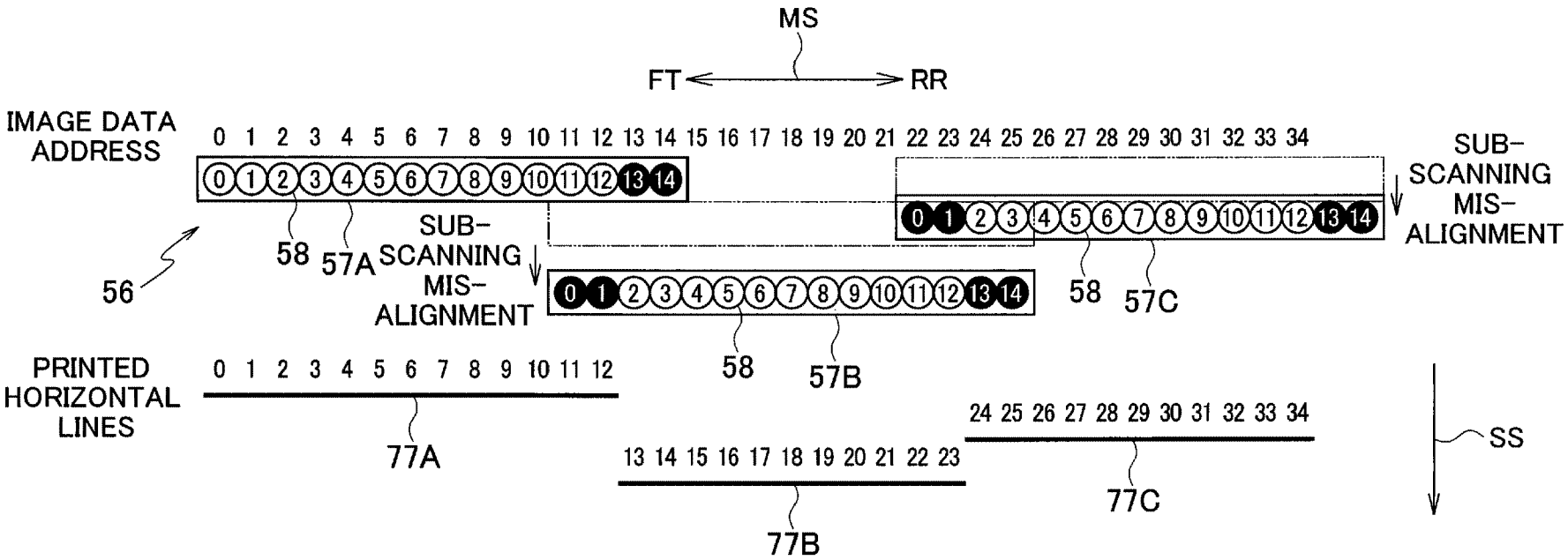
FIG. 6 is a schematic view illustrating an example of a state where the print heads in the print bar are misaligned in the sub-scanning direction.

FIG. 6 illustrates an example of a state where the print heads 57 are misaligned in the sub-scanning direction in the print bar 56 unlike in the ideal state as in FIG. 5. In the example of FIG. 6, the positions of the print heads 57B, 57C with respect to the print head 57A are displaced downstream of their proper positions in FIG. 5.

When the print heads 57 are misaligned in the sub-scanning direction in the print bar 56 as in FIG. 6, print image misregistration occurs if the ink ejection is performed in the print heads 57A to 57C at the same timings as in the ideal state of FIG. 5. The print image quality thereby decreases.

Specifically, for example, when the print heads 57A to 57C perform the ink ejection in the state of FIG. 6 at the same timings as in the ideal state of FIG. 5 to print the horizontal line 76 in FIG. 5, horizontal lines 77A to 77C in FIG. 6 are printed. The horizontal lines 77A to 77C are straight lines extending in the main scanning direction and printed by the print heads 57A to 57C, respectively. The horizontal lines 77B, 77C are printed to be displaced downstream of the horizontal line 77A by amounts corresponding to misalignment amounts of the print heads 57B, 57C in the sub-scanning direction, respectively. As a result, the target straight line 76 illustrated in FIG. 5 cannot be obtained.

The print head sub-scanning adjustment processing is processing of reducing a decrease in print image quality caused by the aforementioned misalignment of the print heads 57 in the sub-scanning direction in each print bar 56 by setting timing adjustment values Th for ink ejection in the print heads 57.

Figure 7:
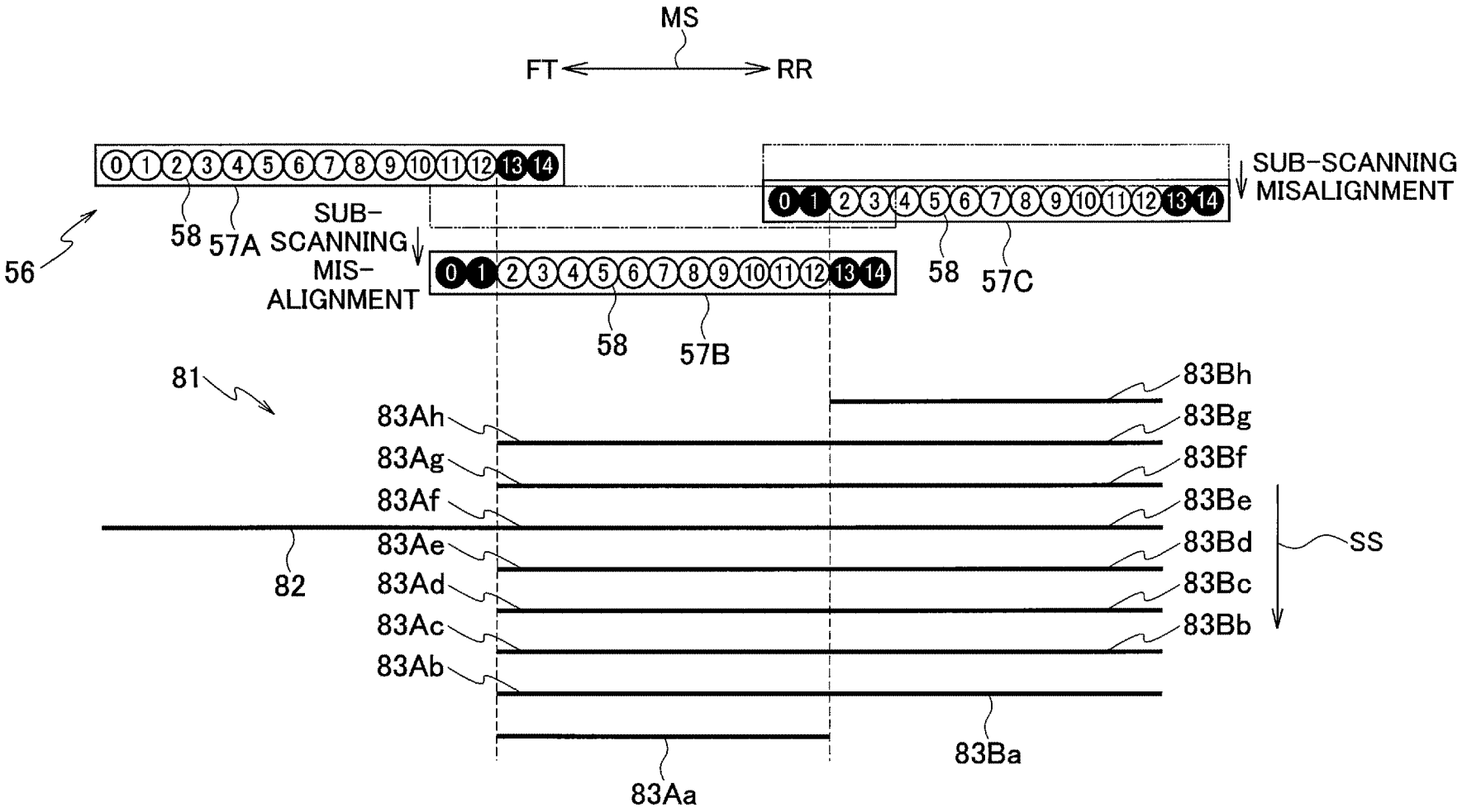
FIG. 7 is a view illustrating an example of a test pattern in print head sub-scanning adjustment processing.

In the print head sub-scanning adjustment processing, the printer controller 24 controls the print heads 57 in each print bar 56 to cause the print heads 57 to print a test pattern 81 illustrated in FIG. 7 for each print bar 56 while conveying the web W at predetermined print conveyance speed. Positional relationships among the print heads 57A to 57C in the example of FIG. 7 are the same as those in the example of FIG. 6. The test pattern 81 includes a head reference straight line 82 and head adjustment straight lines 83Aa to 83Ah and 83Ba to 83Bh. The printer controller 24 stores the head adjustment straight lines 83Aa to 83Ah and 83Ba to 83Bh included in the test pattern 81 in an identifiable manner and also stores the timing adjustment values Th corresponding to the respective head adjustment straight lines 83Aa to 83Ah and 83Ba to 83Bh in, for example, the storage. For example, the printer controller 24 stores the head adjustment straight lines 83Aa to 83Ah and 83Ba to 83Bh, pieces of identification information (for example, IDs) corresponding to the respective lines 83Aa to 83Ah and 83Ba to 83Bh, and the timing adjustment values Th corresponding to the respective lines 83Aa to 83Ah and 83Ba to 83Bh as a correspondence table in the storage. Moreover, the pieces of identification information (for example, IDs) corresponding to the respective head adjustment straight lines 83Aa to 83Ah and 83Ba to 83Bh may be printed together with the lines 83Aa to 83Ah and 83Ba to 83Bh in the test pattern 81.

The head reference straight line 82 is a straight line extending in the main scanning direction and printed by a reference print head which is one of the print heads 57A to 57J. In this example, the print head 57A is set as the reference print head.

The head adjustment straight lines 83 are straight lines extending in the main scanning direction and printed by each of the print heads 57 (non-reference print heads) other than the print head 57A which is the reference print head at timings corresponding to the timing adjustment values Th.

In the example of FIG. 7, the head adjustment straight lines 83 are printed by the print heads 57B, 57C at timings corresponding to eight timing adjustment values Th1 to Th8 and eight head adjustment straight lines 83 (head adjustment straight lines 83Aa to 83Ah or 83Ba to 83Bh) are thus printed by each print head 57.

The timing adjustment values Th1 to Th8 are adjustment values for adjusting the print timing per main scanning line in each of the print heads 57 other than the print head 57A which is the reference print head, with respect to a reference timing per main scanning line in each of the print heads 57 other than the print head 57A.

Here, the reference timing in each of the print heads 57 other than the print head 57A is a print timing at which each of the print heads 57 other than the print head 57A prints a line along the same main scanning line as the print head 57A when the print head 57 is not misaligned in the sub-scanning direction in the print bar 56.

The timing adjustment value Th4 is a value which sets the print timings of the print heads 57B to 57J to the same timing as the reference timing, and the timing adjustment value Th4 is "0." In the example of FIG. 7, the head adjustment straight lines 83Ad, 83Bd are printed at the same timing as the reference timing corresponding to the timing adjustment value Th4.

In the example of FIG. 7, the print heads 57B, 57C are displaced downstream of their proper positions in the sub-scanning direction. Accordingly, the head adjustment straight lines 83Ad, 83Bd corresponding to the timing adjustment value Th4 are printed downstream of the head reference straight line 82, by an amount corresponding to downstream displacement amounts of the print heads 57B, 57C.

The timing adjustment values Th1 to Th3 are values for setting the print timings of the print heads 57 earlier than the reference timing. Accordingly, the head adjustment straight lines 83Aa to 83Ac and 83Ba to 83Bc corresponding to the timing adjustment values Th1 to Th3 are printed downstream of the head adjustment straight lines 83Ad, 83Bd. Meanwhile, the timing adjustment values Th5 to Th8 are values for setting the print timings of the print heads 57 later than the reference timing. Accordingly, the head adjustment straight lines 83Ae to 83Ah and 83Be to 83Bh corresponding to the timing adjustment values Th5 to Th8 are printed upstream of the head adjustment straight lines 83Ad, 83Bd.

The timing adjustment values Th1 to Th8 are set such that an interval between each pair of adjacent head adjustment straight lines 83 in the sub-scanning direction is so large that the head adjustment straight lines 83 are distinguishable by the human eye.

Note that, in FIG. 7, the head adjustment straight lines 83 other than the head adjustment straight lines 83Aa to 83Ah and 83Ba to 83Bh printed by the print heads 57B, 57C are omitted. However, the test pattern 81 also includes the head adjustment straight lines 83 printed by the print heads 57D to 57J at timings corresponding to the timing adjustment values Th1 to Th8.

A worker such as a service person visually checks the test pattern 81 printed on the web W with the naked eye or by using a magnifying glass. From the multiple head adjustment straight lines 83 printed by each of the print heads 57 other than the print head 57A, the worker selects the head adjustment straight line 83 with the smallest print misalignment amount in the sub-scanning direction with respect to the head reference straight line 82.

Then, the worker performs an input operation of specifying the head adjustment straight line 83 with the smallest print misalignment amount in the sub-scanning direction with respect to the head reference straight line 82 for each of the print heads 57 other than the print head 57A, on the operation panel 23. This input operation includes, for example, specifying the identification information (for example, ID) of any of the head adjustment straight lines 83Aa to 83Ah and 83Ba to 83Bh printed in the test pattern 81. Note that the information to be specified is not limited to the ID and may be, for example, any information indicating the number of the line to be specified from the head reference straight line 82 in the order in the left-right direction parallel to the sub-scanning direction. The operation panel 23 outputs head adjustment straight line specifying information for each of the print heads 57 other than the print head 57A to the printer controller 24 based on this input operation. The head adjustment straight line specifying information is information specifying the head adjustment straight line 83 with the smallest print misalignment amount in the sub-scanning direction with respect to the head reference straight line 82 and is, for example, the ID.

When the printer controller 24 receives the head adjustment straight line specifying information for each of the print heads 57 other than the print head 57A, the printer controller 24 sets (determines), for each of the print heads 57 other than the print head 57A, the timing adjustment value Th corresponding to the head adjustment straight line 83 specified by the head adjustment straight line specifying information, as the timing adjustment value Th of the ink ejection in the print head 57 in normal printing. For example, when the printer controller 24 receives the identification information (for example, ID) which is the head adjustment straight line specifying information for each of the print heads 57 other than the print head 57A, the printer controller 24 refers to the correspondence table for each of the print heads 57 other than the print head 57A to determine the timing adjustment value Th corresponding to the identification information (for example, ID) and sets the determined timing adjustment value Th as the timing adjustment value Th of the ink ejection in the print head 57.

In the example of FIG. 7, the head adjustment straight line 83Af among the head adjustment straight lines 83Aa to 83Ah for the print head 57B has the smallest print misalignment amount in the sub-scanning direction with respect to the head reference straight line 82. Accordingly, the timing adjustment value Th6 corresponding to the head adjustment straight line 83Af is set as the timing adjustment value Th of the ink ejection in the print head 57B.

Moreover, the head adjustment straight line 83Be among the head adjustment straight lines 83Ba to 83Bh for the print head 57C has the smallest print misalignment amount in the sub-scanning direction with respect to the head reference straight line 82. Accordingly, the timing adjustment value Th5 corresponding to the head adjustment straight line 83Be is set as the timing adjustment value Th of the ink ejection in the print head 57C.

When the timing adjustment values Th of ink ejection for the respective print heads 57B to 57J are set in all print bars 56, the print head sub-scanning adjustment processing is terminated.

Next, in step S2 of FIG. 4, the printer controller 24 executes the seam portion adjustment processing. The seam portion adjustment processing is processing of adjusting misalignment of the print heads 57 in the main scanning direction in each print bar 56.

Figure 8:
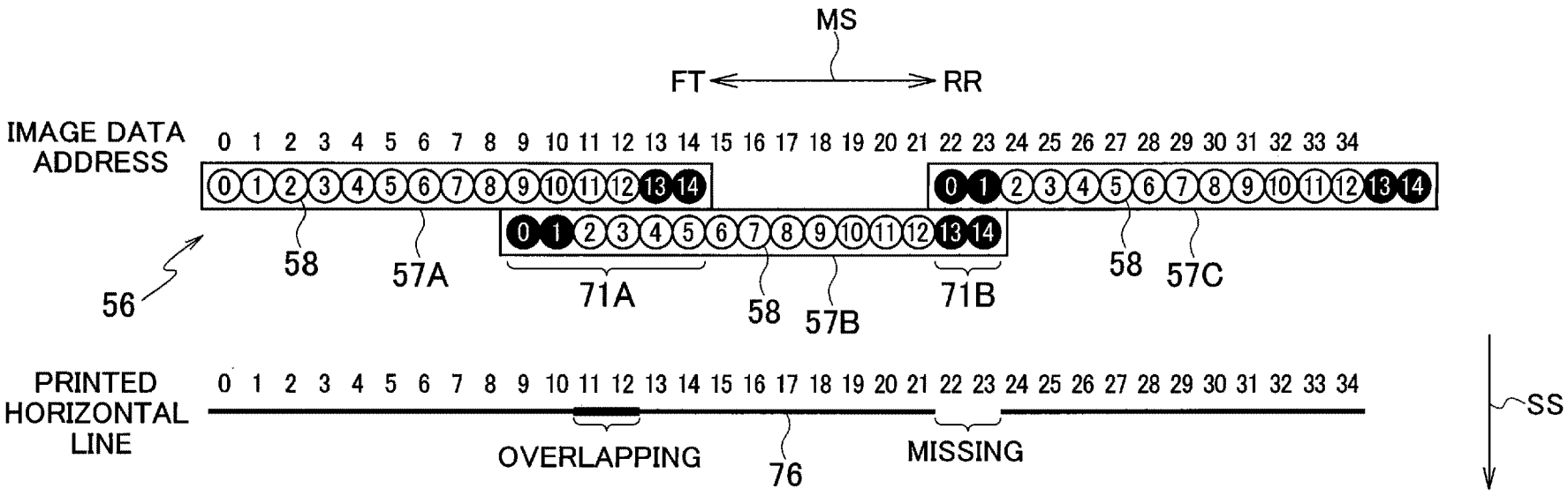
FIG. 8 is a schematic view illustrating an example of a state where the print heads are misaligned in the main scanning direction in the print bar.

FIG. 8 illustrates an example of a state where the print heads 57 are misaligned in the main scanning direction in the print bar 56 with respect to the ideal state of FIG. 5. In FIG. 8, the print head 57B is displaced toward the print head 57A by an amount corresponding to two pitches of the nozzles 58.

When the nozzles 58 set as the nozzles to be used on the assumption that the print bar 56 is in the ideal state of FIG. 5 are used to print the horizontal line 76 in the state of FIG. 8, line overlapping occurs in a printed portion in the overlap region 71A.

Specifically, the nozzle 58 with the nozzle number N=11 in the print head 57A and the nozzle 58 with the nozzle number N=2 in the print head 57B eject the ink to the same position. Moreover, the nozzle 58 with the nozzle number N=12 in the print head 57A and the nozzle 58 with the nozzle number N=3 in the print head 57B eject the ink to the same position. The line overlapping portion is thereby formed in the horizontal line 76 as illustrated in FIG. 8.

Meanwhile, since there is no nozzle to be used in the overlap region 71B, line missing occurs in a portion of the horizontal line 76 corresponding to the overlap region 71B.

As described above, when the print head 57 is misaligned in the main scanning direction in the print bar 56, overlapping and missing of the nozzles to be used in the main scanning direction occurs. In the overlap region 71 in which there is overlapping of the nozzles to be used in the main scanning direction, a black stripe extending in the sub-scanning direction is formed in the print image. Moreover, in the overlap region 71 in which there is missing of the nozzles to be used in the main scanning direction, a white stripe extending in the sub-scanning direction is formed in the print image. The print image quality thereby decreases.

The seam portion adjustment processing is processing of reducing the aforementioned decrease in print image quality caused by the misalignment of the print head 57 in the main scanning direction in the print bar 56 by setting the nozzles to be used in each overlap region 71 depending on the misalignment of the print head 57 in the main scanning direction.

In the seam portion adjustment processing, the printer controller 24 first causes a front (one) print head 57 out of the print heads 57 adjacent to each other in the main scanning direction to print, on the web W, a front (one) seam portion adjustment straight line by using a specified number L of the nozzles 58 from an overlap region (rear) side end of the front (one) print head 57 and causes a rear (other) print head 57 to print, on the web W, a rear (other) seam portion adjustment straight line by using the specified number L of the nozzles 58 from an overlap region (front) side end of the rear (other) print head 57 while conveying the web W.

Figure 9:
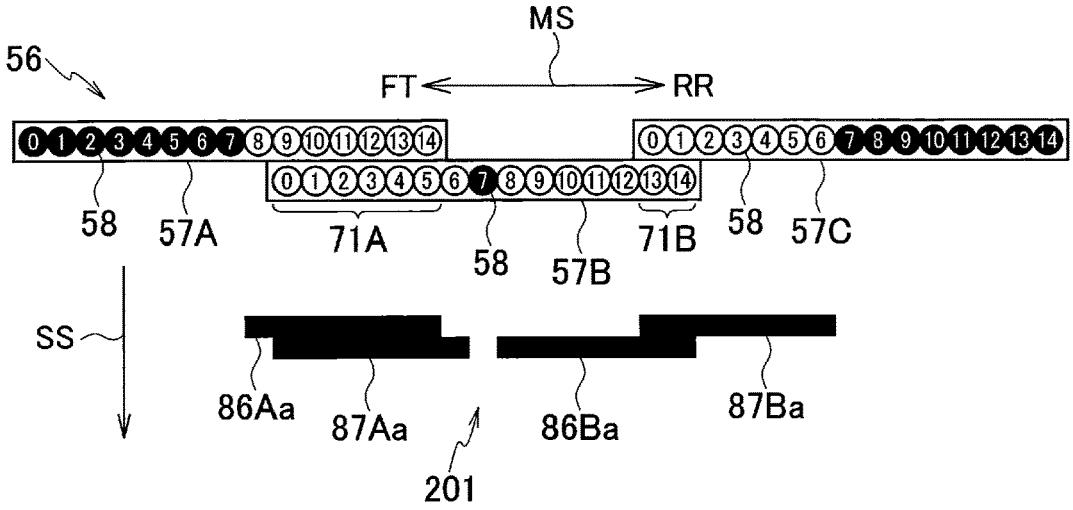
FIG. 9 is an explanatory view of seam portion adjustment straight lines in seam portion adjustment processing.

For example, regarding the print heads 57A, 57B in the state of FIG. 8, as illustrated in FIG. 9, the printer controller 24 causes the front print head 57A to print the front seam portion adjustment straight line 86Aa and causes the rear print head 57B to print the rear seam portion adjustment straight line 87Aa. Moreover, regarding the print heads 57B, 57C in the state of FIG. 8, as illustrated in FIG. 9, the printer controller 24 causes the front print head 57B to print the front seam portion adjustment straight line 86Ba and causes the rear print head 57C to print the rear seam portion adjustment straight line 87Ba.

In the example of FIG. 9, the specified number L is seven. Specifically, each of the seam portion adjustment straight lines 86Aa, 86Ba is printed by using seven nozzles 58 from the rear side of a corresponding one of the print heads 57A, 58B. Moreover, each of the seam portion adjustment straight lines 87Aa, 87Ba is printed by using seven nozzles 58 from the front side of a corresponding one of the print heads 57B, 57C.

The specified number L is set in advance and is a number greater than the number of the nozzles 58 overlapping in the overlap region 71 in the ideal state where the print heads 57 are not misaligned in the print bar 56 as illustrated in FIG. 5.

The seam portion adjustment straight lines 86, 87 are horizontal lines with a width corresponding to multiple pixels and are printed while being shifted from each other in the sub-scanning direction by an amount corresponding to this width. The seam portion adjustment straight lines 86, 87 are set to be lines with a width corresponding to multiple pixels to make the overlapping portion of the seam portion adjustment straight lines 86, 87 in the main scanning direction more visible to the worker. Note that, as a modified example, the seam portion adjustment straight lines 86, 87 may be printed with their positions in the sub-scanning direction matching each other as in a test pattern 203 illustrated in FIGS. 18 to 26. A method of printing the test pattern 203 is the same as the method of printing the test pattern 201 other than the point that the seam portion adjustment straight lines 86, 87 are printed with their positions in the sub-scanning direction matching each other. In this modified example, the seam portion adjustment straight lines 86, 87 may be horizontal lines with a width corresponding to one pixel.

The printing of the seam portion adjustment straight lines 86, 87 by the print heads 57B to 57J are performed by using the timing adjustment values Th set in the aforementioned print head sub-scanning adjustment processing.

After the seam portion adjustment straight lines 86, 87 are printed by using the specified number L of nozzles, the printer controller 24 controls the print heads 57 adjacent to each other in the main scanning direction such that the front print head 57 and the rear print head 57 perform an operation a specified number M of times while the front print head 57 and the rear print head 57 alternately reduces the number of the nozzles 58 to be used by one from the overlap region side each time, the operation being an operation in which the front print head 57 prints the front seam portion adjustment straight line 86 and the rear print head 57 prints the rear seam portion adjustment straight line 87.

Figure 10:
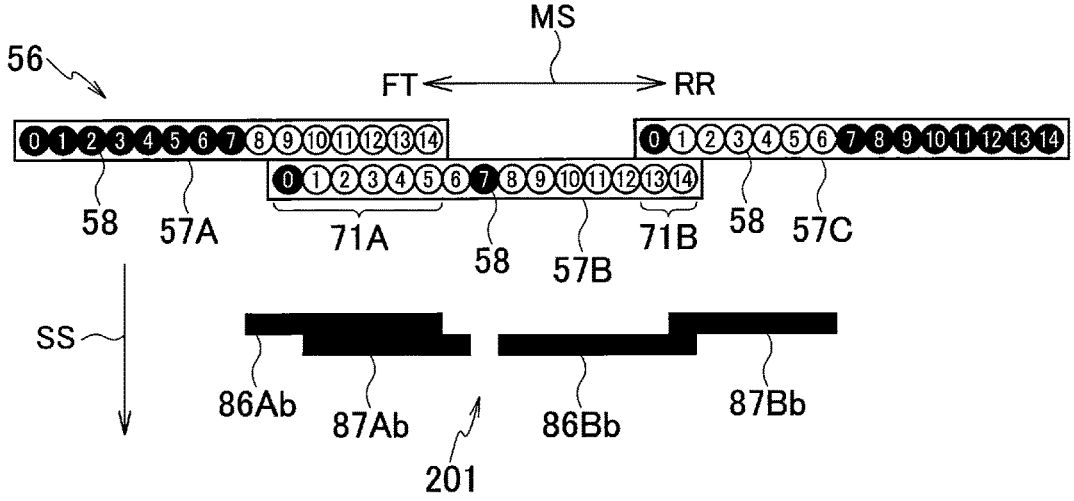
FIG. 10 is an explanatory view of the seam portion adjustment straight lines in the seam portion adjustment processing.

For example, after the print heads 57A to 57C print the seam portion adjustment straight lines 86Aa, 87Aa, 86Ba, 87Ba as illustrated in FIG. 9, the printer controller 24 causes the print heads 57A to 57C to print seam portion adjustment straight lines 86Ab, 87Ab, 86Bb, 87Bb as illustrated in FIG. 10.

The seam portion adjustment straight line 87Ab in FIG. 10 is a line printed by the print head 57B with the number of the nozzles 58 to be used reduced by one from that in the printing of the seam portion adjustment straight line 87Aa in FIG. 9, from the overlap region side (front side) with the print head 57A. Moreover, the seam portion adjustment straight line 87Bb is a line printed by the print head 57C with the number of the nozzles 58 to be used reduced by one from that in the printing of the seam portion adjustment straight line 87Ba in FIG. 9, from the overlap region side (front side) with the print head 57B. The seam portion adjustment straight lines 86Ab, 86Bb are the same as the seam portion adjustment straight lines 86Aa, 86Ba in FIG. 9, respectively.

Figure 11:
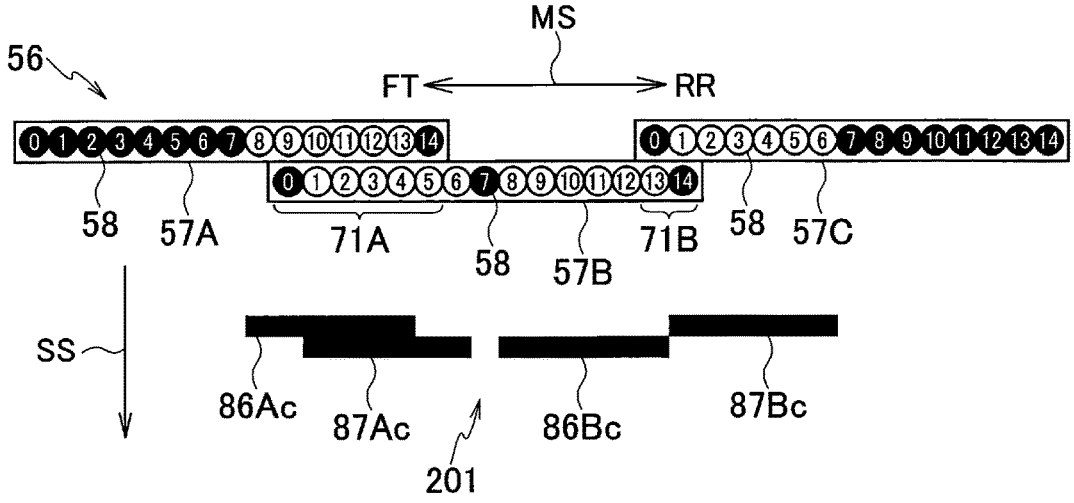
FIG. 11 is an explanatory view of the seam portion adjustment straight lines in the seam portion adjustment processing.
Figure 12:
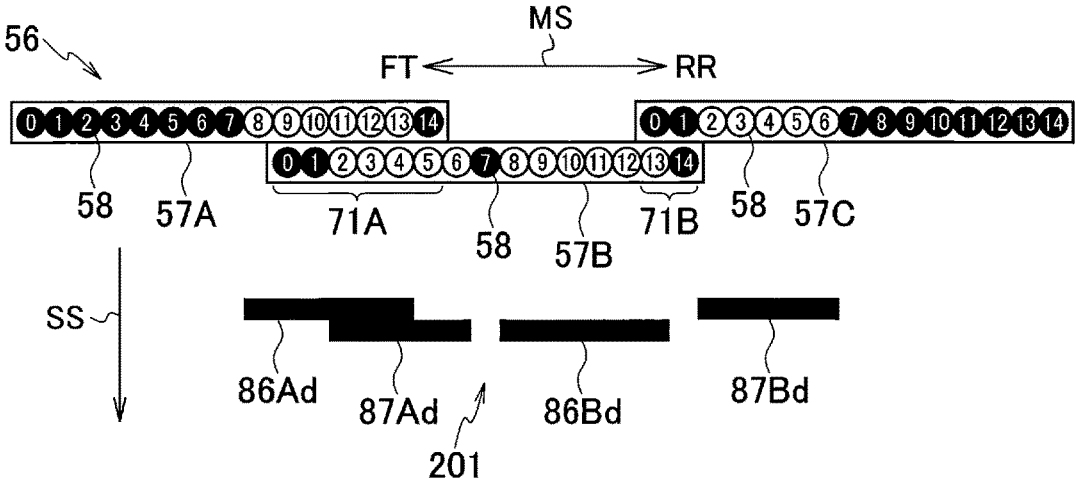
FIG. 12 is an explanatory view of the seam portion adjustment straight lines in the seam portion adjustment processing.
Figure 13:
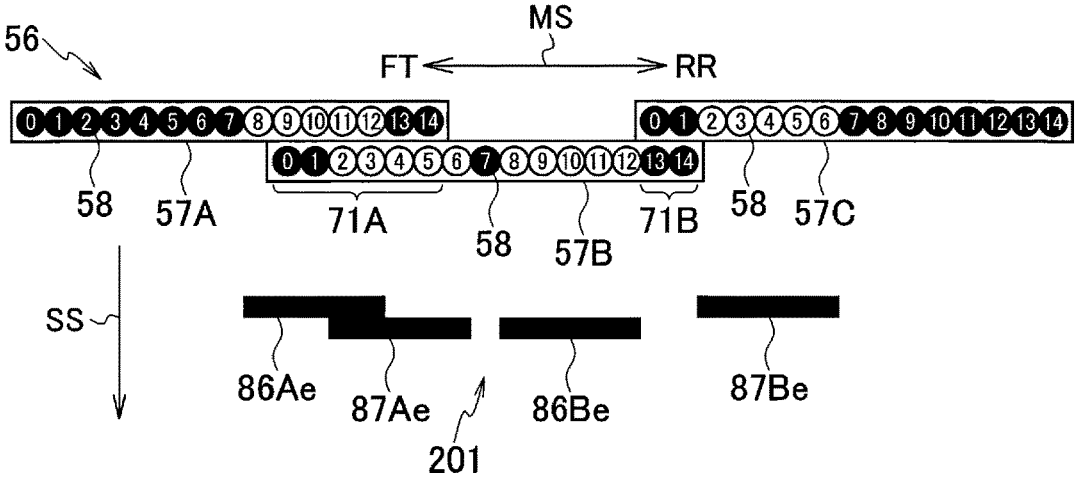
FIG. 13 is an explanatory view of the seam portion adjustment straight lines in the seam portion adjustment processing.
Figure 14:
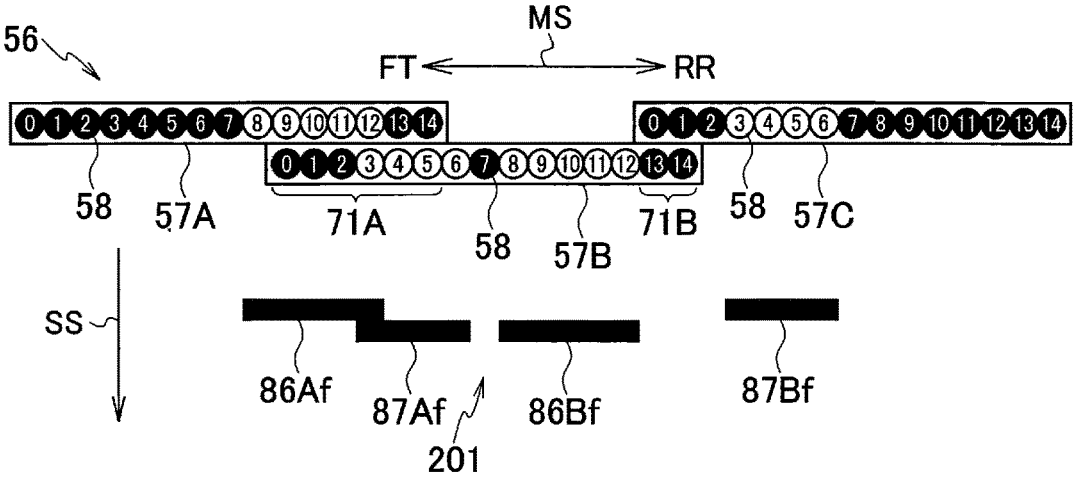
FIG. 14 is an explanatory view of the seam portion adjustment straight lines in the seam portion adjustment processing.

After the printing of the seam portion adjustment straight lines 86Ab, 87Ab, 86Bb, 87Bb in FIG. 10, the printer controller 24 causes the print heads 57A to 57C to print the seam portion adjustment straight lines 86Ac, 87Ac, 86Bc, 87Bc as illustrated in FIG. 11.

The seam portion adjustment straight line 86Ac in FIG. 11 is a line printed by the print head 57A with the number of the nozzles 58 to be used reduced by one from that in the printing of the seam portion adjustment straight line 86Aa in FIG. 9 and the seam portion adjustment straight line 86Ab in FIG. 10, from the overlap region (rear) side. Moreover, the seam portion adjustment straight line 86Bc is a line printed by the print head 57B with the number of the nozzles 58 to be used reduced by one from that in the printing of the seam portion adjustment straight line 86Ba in FIG. 9 and the seam portion adjustment straight line 86Bb in FIG. 10, from the overlap region (rear) side with the print head 57C. The seam portion adjustment straight lines 87Ac, 87Bc are the same as the seam portion adjustment straight lines 87Ab, 87Bb in FIG. 10, respectively.

Hereafter, the printer controller 24 causes the print heads 57A, 57B to print seam portion adjustment straight lines 86Ad to 86Ai and 87Ad to 87Ai while the print heads 57A, 57B alternately reduce the number of the nozzles 58 to be used by one from the overlap region side of each print head 57 each time, as illustrated in FIGS. 12 to 17. Moreover, the printer controller 24 causes the print heads 57B, 58C to print seam portion adjustment straight lines 86Bd to 86Bi and 87Bd to 87Bi while the print heads 57B, 58C alternately reduce the number of the nozzles 58 to be used by one from the overlap region side of each print head 57 each time.

In the example of FIGS. 9 to 17, the aforementioned specified number M is eight. The specified number M is set in advance depending on the aforementioned specified number L as the number of times the print heads 57 need to perform the operation of printing the seam portion adjustment straight lines 86, 87 with the number of nozzles to be used reduced by one each time until overlapping of the nozzles to be used in the main scanning direction is eliminated in the overlap region 71.

As a result of the aforementioned print operation of the seam portion adjustment straight lines 86, 87 in the seam portion adjustment processing, (M+1) combinations (test pattern 201) of the seam portion adjustment straight lines 86, 87 corresponding to combinations of the used nozzles 58 are printed on the web W for each overlap region 71. In the example of FIGS. 9 to 17, nine combinations of the seam portion adjustment straight lines 86, 87 are printed for each of the overlap regions 71A, 71B. The printer controller 24 stores the multiple combinations of the seam portion adjustment straight lines 86, 87 included in the test pattern 201 in an identifiable manner and also stores the combinations of the nozzles 58 for printing the respective combinations of the seam portion adjustment straight lines 86, 87 in, for example, the storage. For example, the printer controller 24 stores the multiple combinations of the seam portion adjustment straight lines 86, 87, pieces of identification information (for example, IDs) corresponding to the respective combinations, and the combinations of the nozzles 58 corresponding to the respective combinations of the seam portion adjustment straight lines 86, 87 in the storage as a correspondence table. Moreover, the pieces of identification information (for example, IDs) corresponding to the respective combinations of the seam portion adjustment straight lines 86, 87 may be printed in the test pattern 201 together with the combinations.

The worker visually checks each of the combinations of the seam portion adjustment straight lines 86, 87 printed on the web W. For each overlap region 71 between the print heads 57 adjacent to each other in the main scanning direction, the worker selects a combination which forms no gap between the seam portion adjustment straight lines 86, 87 in the main scanning direction and which has the smallest overlapping portion between the seam portion adjustment straight lines 86, 87, from the (M+1) combinations of the seam portion adjustment straight lines 86, 87.

Then, for each overlap region 71 between the print heads 57 adjacent to each other in the main scanning direction, the worker performs an input operation of specifying the combination which forms no gap between the seam portion adjustment straight lines 86, 87 in the main scanning direction and which has the smallest overlapping portion between the seam portion adjustment straight lines 86, 87, from the (M+1) combinations of the seam portion adjustment straight lines 86, 87, on the operation panel 23. This input operation includes, for example, specifying identification information (for example, ID) of any of the combinations of the seam portion adjustment straight lines 86, 87 printed in the test pattern 201. Note that the information to be specified is not limited to the ID and may be any information by which the multiple combinations of the seam portion adjustment straight lines 86, 87 can be identified. The operation panel 23 outputs seam portion adjustment straight line specifying information for each overlap region 71 to the printer controller 24 based on the input operation. The seam portion adjustment straight line specifying information is information specifying the combination of the seam portion adjustment straight lines 86, 87 which forms no gap between the seam portion adjustment straight lines 86, 87 in the main scanning direction and which has the smallest overlapping portion between the seam portion adjustment straight lines 86, 87 and is, for example, the ID.

When the printer controller 24 receives the seam portion adjustment straight line specifying information for each overlap region 71, the printer controller 24 sets (determines) the nozzles 58 used in the front print head 57 and the rear print head 57 in the overlap region 71 in the printing of the combination of the seam portion adjustment straight lines 86, 87 specified by the seam portion adjustment straight line specifying information, as the nozzles to be used in the overlap region 71 in normal printing. For example, when the printer controller 24 receives the identification information (for example, ID) as the seam portion adjustment straight line specifying information for each overlap region 71, the printer controller 24 refers to the correspondence table to determine the nozzles 58 corresponding to the identification information (for example, ID) for the overlap region 71 and sets the determined nozzles 58 as the nozzles to be used in the overlap region 71.

Figure 15:
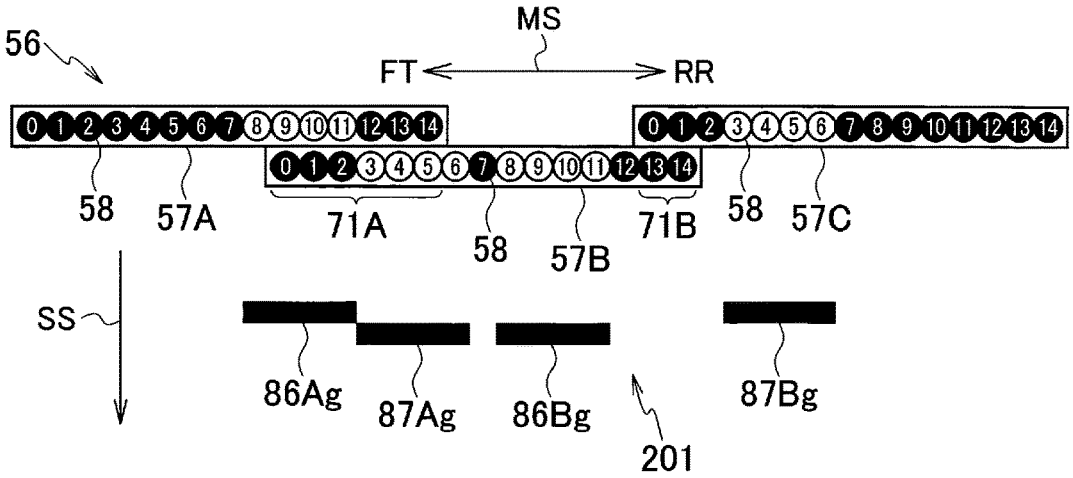
FIG. 15 is an explanatory view of the seam portion adjustment straight lines in the seam portion adjustment processing.
Figure 16:
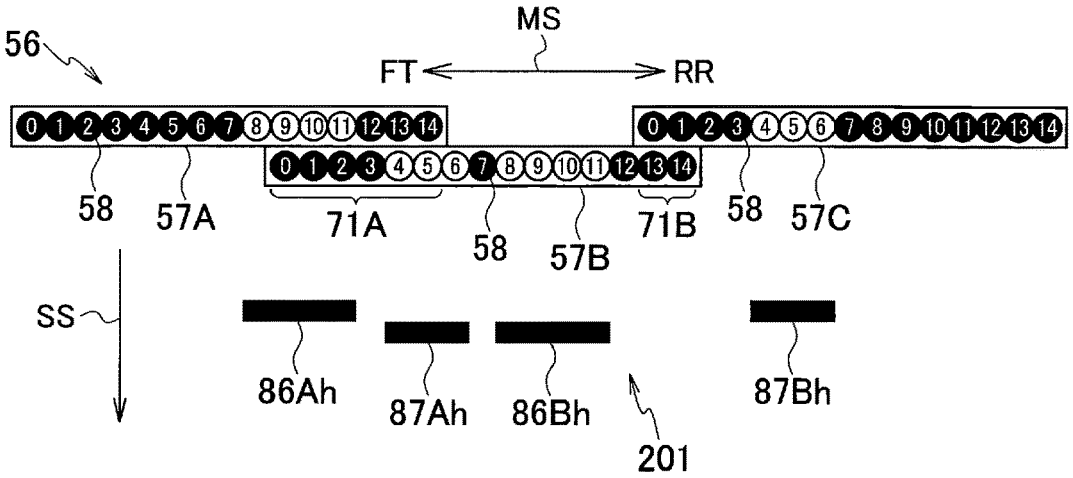
FIG. 16 is an explanatory view of the seam portion adjustment straight lines in the seam portion adjustment processing.
Figure 17:
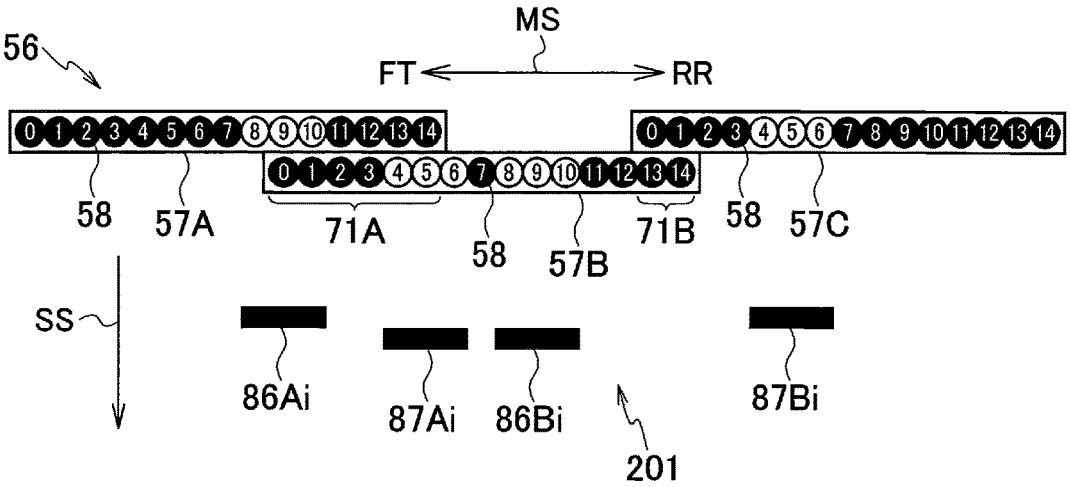
FIG. 17 is an explanatory view of the seam portion adjustment straight lines in the seam portion adjustment processing.
Figure 18:
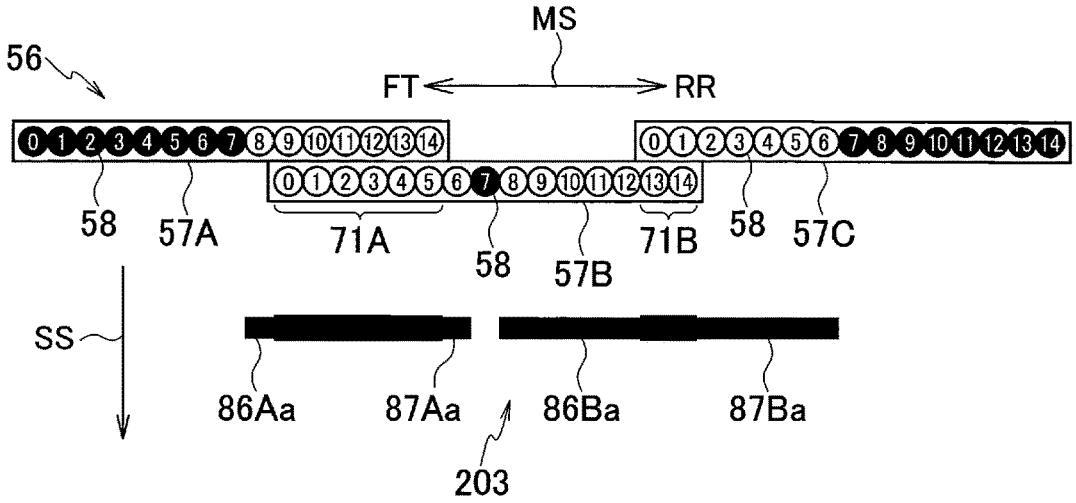
FIG. 18 is an explanatory view of the seam portion adjustment straight lines in the seam portion adjustment processing according to a modified example.
Figure 19:
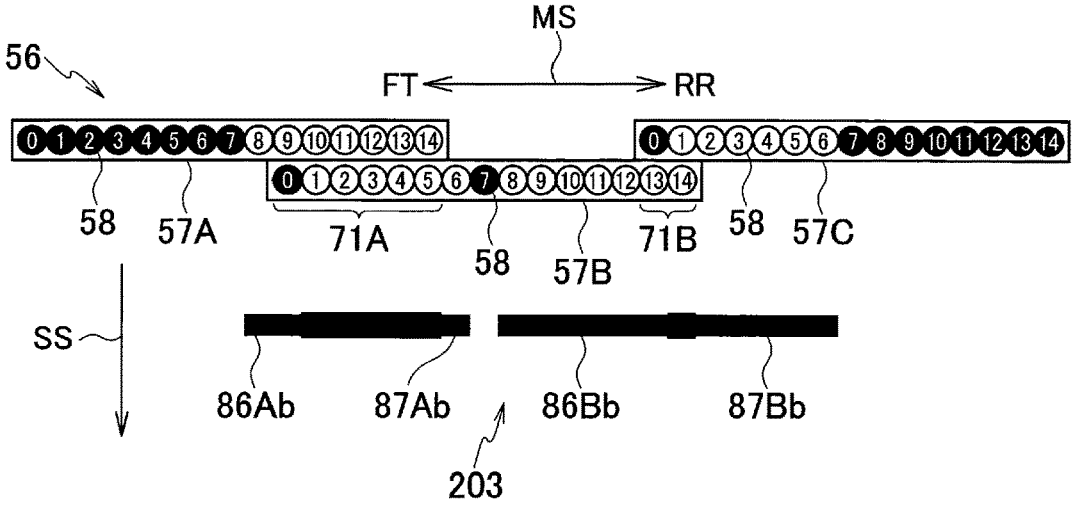
FIG. 19 is an explanatory view of the seam portion adjustment straight lines in the seam portion adjustment processing according to the modified example.

In the example of FIGS. 9 to 17, a combination of the seam portion adjustment straight lines 86Ag, 87Ag among combinations of the seam portion adjustment straight lines 86Aa to 86Ai and 87Aa to 87Ai for the overlap region 71A forms no gap in the main scanning direction and has the smallest overlapping portion. Accordingly, the nozzles 58 with the nozzle numbers N=9 to 11 in the print head 57A and the nozzles 58 with the nozzle numbers N=3 to 5 in the print head 57B are set as the nozzles to be used in the overlap region 71A (FIG. 15).

Moreover, a combination of the seam portion adjustment straight lines 86Bc, 87Bc among combinations of the seam portion adjustment straight lines 86Ba to 86Bi and 87Ba to 87Bi for the overlap region 71B forms no gap in the main scanning direction and has the smallest overlapping portion. Accordingly, the nozzle 58 with the nozzle number N=13 in the print head 57B and the nozzle 58 with the nozzle number N=1 in the print head 57C are set as the nozzles to be used in the overlap region 71B (FIG. 11).

When the nozzles to be used are set for all overlap regions 71 in all print bars 56, the seam portion adjustment processing is terminated.

Figure 20:
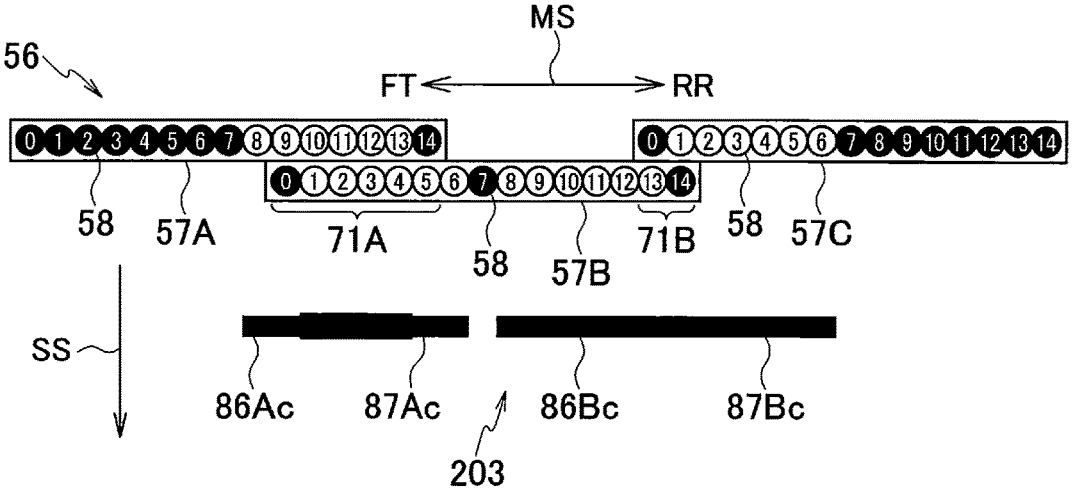
FIG. 20 is an explanatory view of the seam portion adjustment straight lines in the seam portion adjustment processing according to the modified example.
Figure 21:
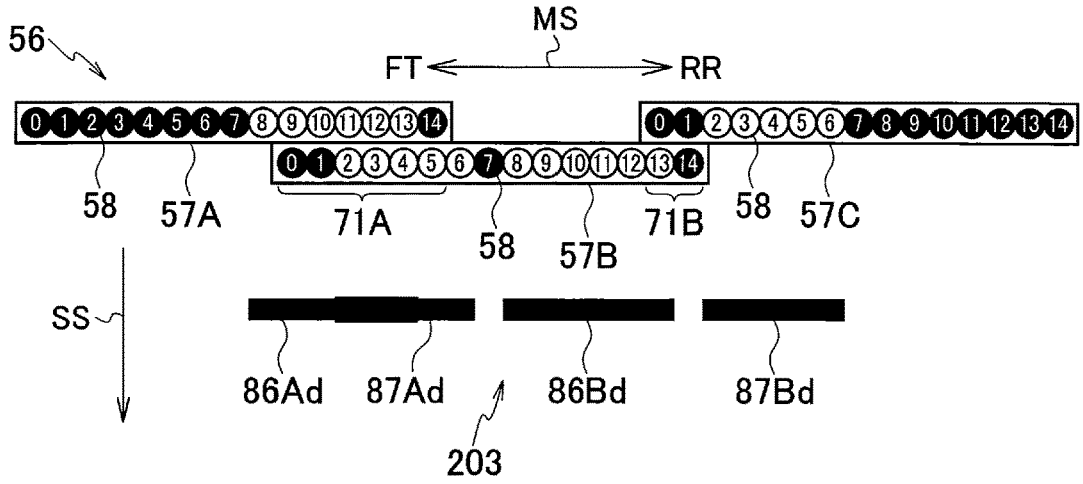
FIG. 21 is an explanatory view of the seam portion adjustment straight lines in the seam portion adjustment processing according to the modified example.
Figure 22:
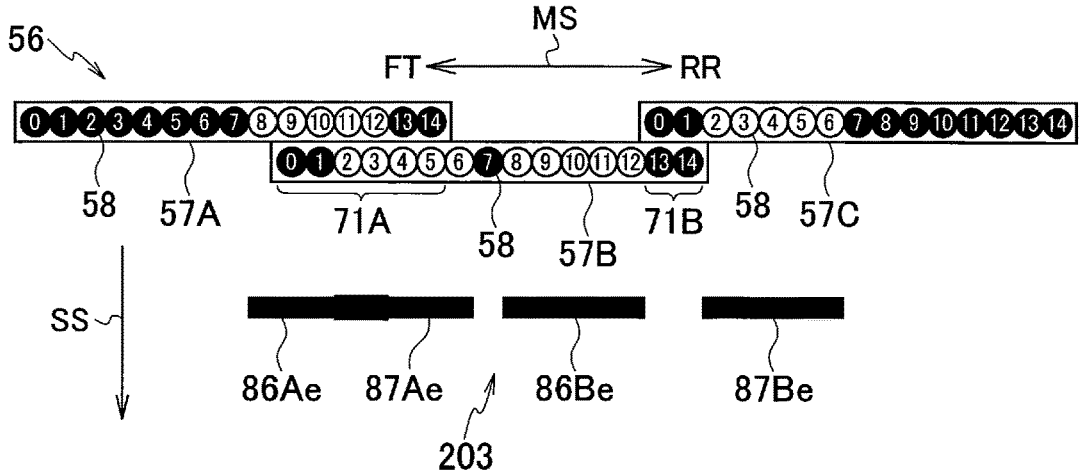
FIG. 22 is an explanatory view of the seam portion adjustment straight lines in the seam portion adjustment processing according to the modified example.
Figure 23:
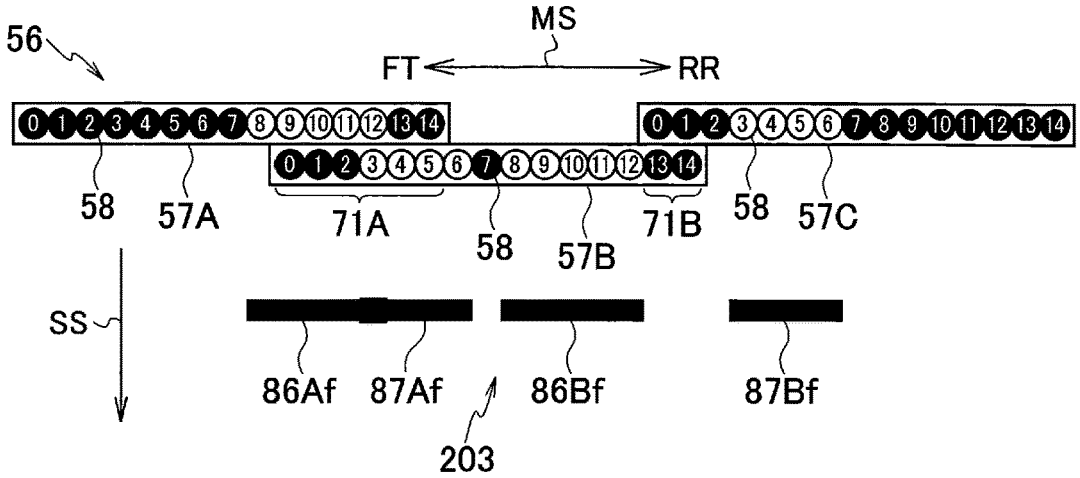
FIG. 23 is an explanatory view of the seam portion adjustment straight lines in the seam portion adjustment processing according to the modified example.
Figure 24:
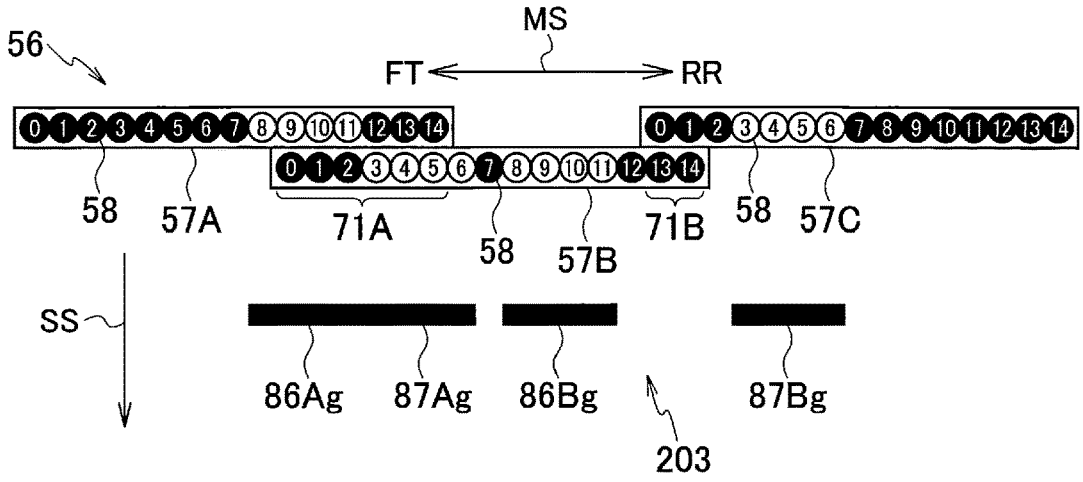
FIG. 24 is an explanatory view of the seam portion adjustment straight lines in the seam portion adjustment processing according to the modified example.
Figure 25:
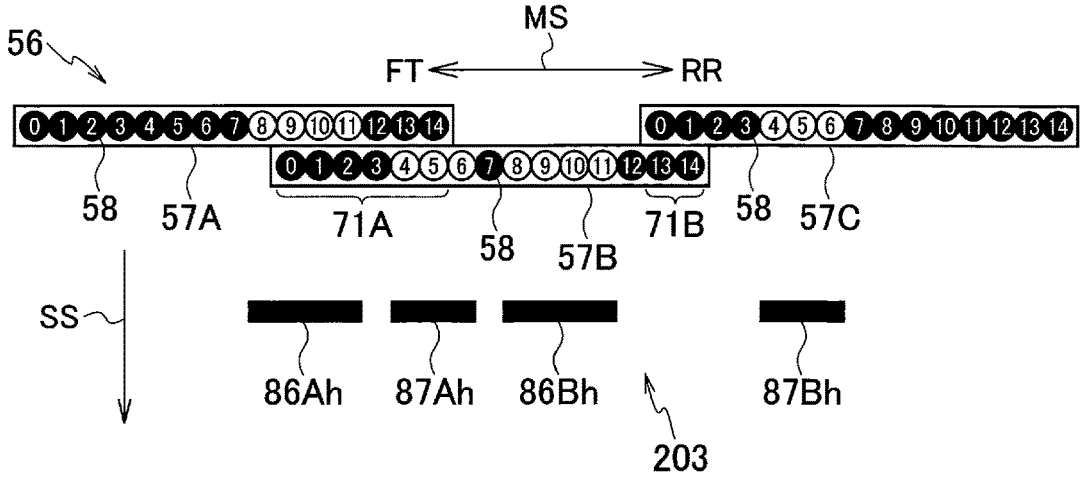
FIG. 25 is an explanatory view of the seam portion adjustment straight lines in the seam portion adjustment processing according to the modified example.
Figure 26:
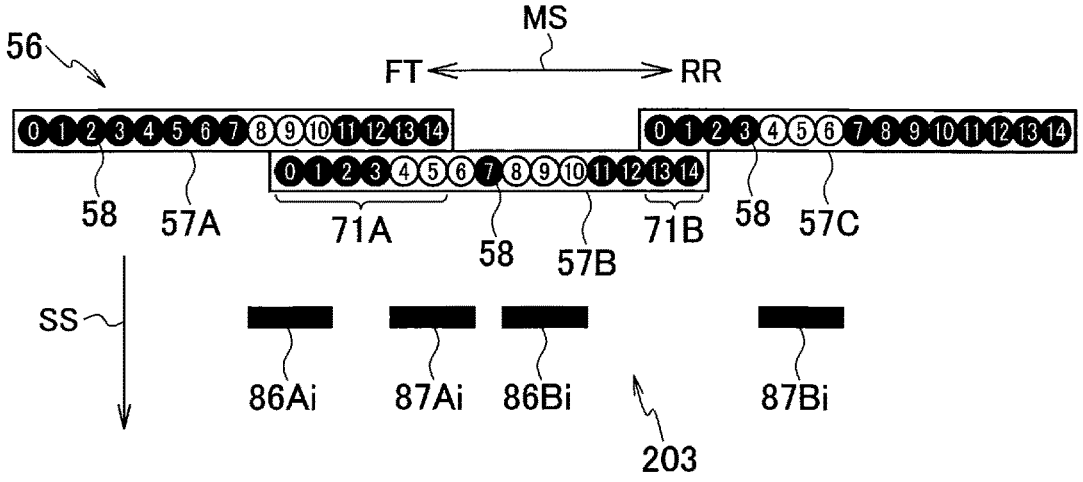
FIG. 26 is an explanatory view of the seam portion adjustment straight lines in the seam portion adjustment processing according to the modified example.

Note that, when the seam portion adjustment straight lines 86, 87 are printed with their positions in the sub-scanning direction matching each other as in the aforementioned modified example, the worker selects the first combination in which the gap between the seam portion adjustment straight lines 86, 87 in the main scanning direction disappears, among the (M+1) combinations of the seam portion adjustment straight lines 86, 87 for each overlap region 71 between the print heads 57 adjacent to each other in the main scanning direction. For example, in the combinations of the seam portion adjustment straight lines 86Aa to 86Ai and 87Aa to 87Ai for the overlap region 71A in multiple test patterns 203 of FIGS. 18 to 26, the worker can visually recognize that the combination of the seam portion adjustment straight lines 86Ag, 87Ag illustrated in FIG. 24 is the first combination in which the gap in the main scanning direction disappears with respect to the combination of the seam portion adjustment straight lines 86Ah, 87Ah of FIG. 25 which has a gap. Moreover, in the combinations of the seam portion adjustment straight lines 86Ba to 86Bi and 87Ba to 87Bi for the overlap region 71B, the worker can visually recognize that the combination of the seam portion adjustment straight lines 86Bc, 87Bc illustrated in FIG. 20 is the first combination in which the gap in the main scanning direction disappears with respect to the combination of the seam portion adjustment straight lines 86Bd, 87Bd of FIG. 21 which has a gap.

Next, in step S3 of FIG. 4, the printer controller 24 executes the print bar sub-scanning adjustment processing. The print bar sub-scanning adjustment processing is processing of adjusting misalignment of the print bars 56 in the sub-scanning direction.

Figure 27:
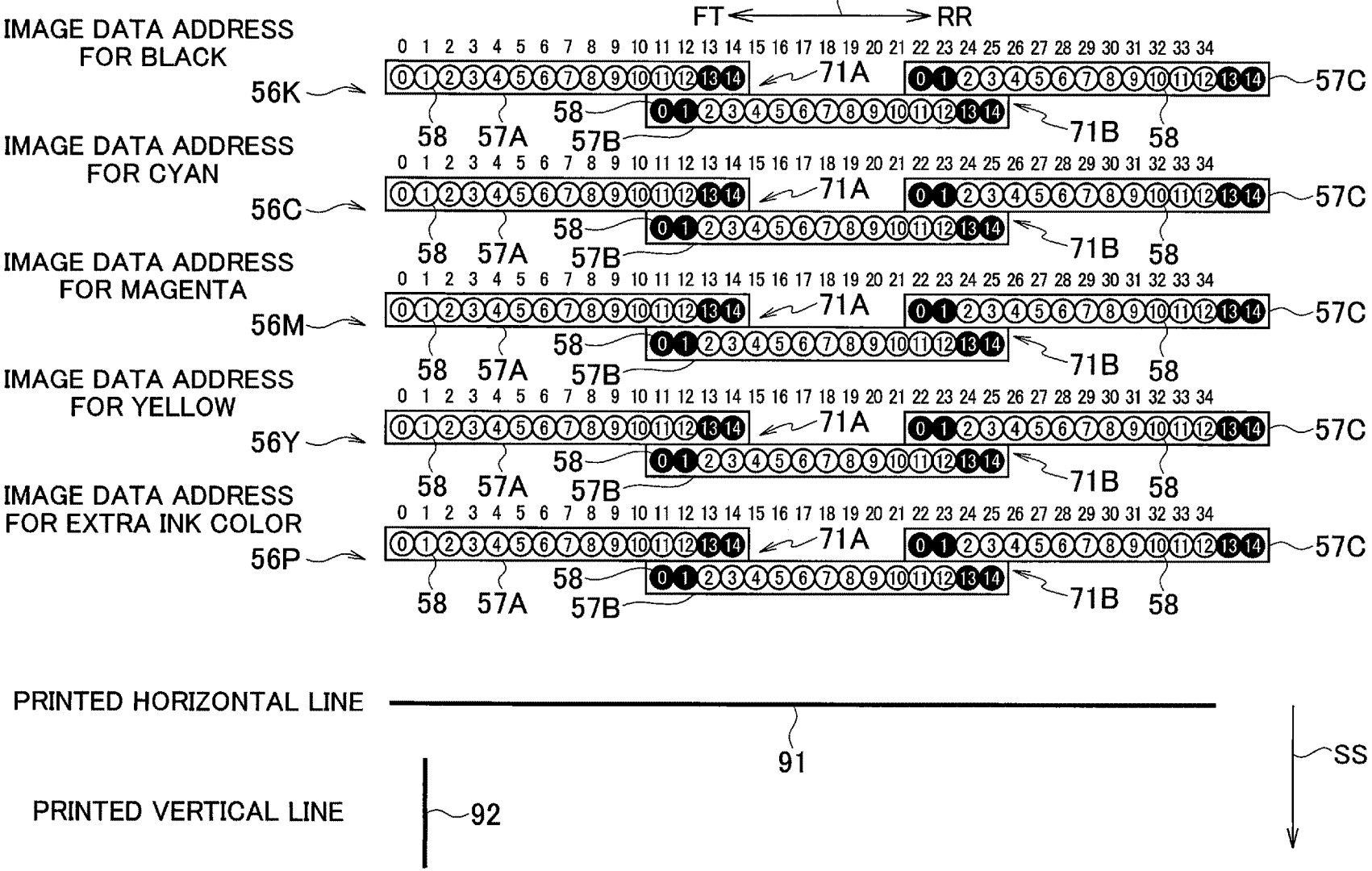
FIG. 27 is a schematic view illustrating a state where the print bars are not misaligned in the main scanning direction and the sub-scanning direction.

FIG. 27 schematically illustrates an ideal state without misalignment of the print bars 56K, 56C, 56M, 56Y, 56P in the main scanning direction and the sub-scanning direction. In FIG. 27, portions of the respective print bars 56 including the print heads 57A to 57C are extracted and illustrated. Moreover, FIG. 27 illustrates a state where the print heads 57 are not misaligned in the main scanning direction and the sub-scanning direction in the print bars 56.

In each printer 22, the further downstream the print bar 56 is located, the later the timing at which the ink is ejected for the same line in the main scanning direction. Specifically, for example, when a horizontal line 91 is to be printed by the print bars 56K, 56C, 56M, 56Y, 56P, ink ejection is performed in the order of the print bars 56K, 56C, 56M, 56Y, 56P. An ink ejection timing of each of the print bars 56C, 56M, 56Y, 56P corresponding to an ink ejection timing of the print bar 56K for the same line in the main scanning direction is set depending on an interval between the print bars 56 in the sub-scanning direction.

Moreover, in the ideal state of FIG. 27, when the inks are ejected from the print bars 56 for pixels at the same position in the main scanning direction, there are used the nozzles 58 of the same nozzle number in the print heads 57 at the same position in the respective print bars 56. For example, when a vertical line 92 which is a straight line extending in the sub-scanning direction and having a width of one pixel is to be printed as illustrated in FIG. 27, there are used the nozzles 58 with the nozzle number N=1 in the print heads 57A in the respective print bars 56.

Figure 28:
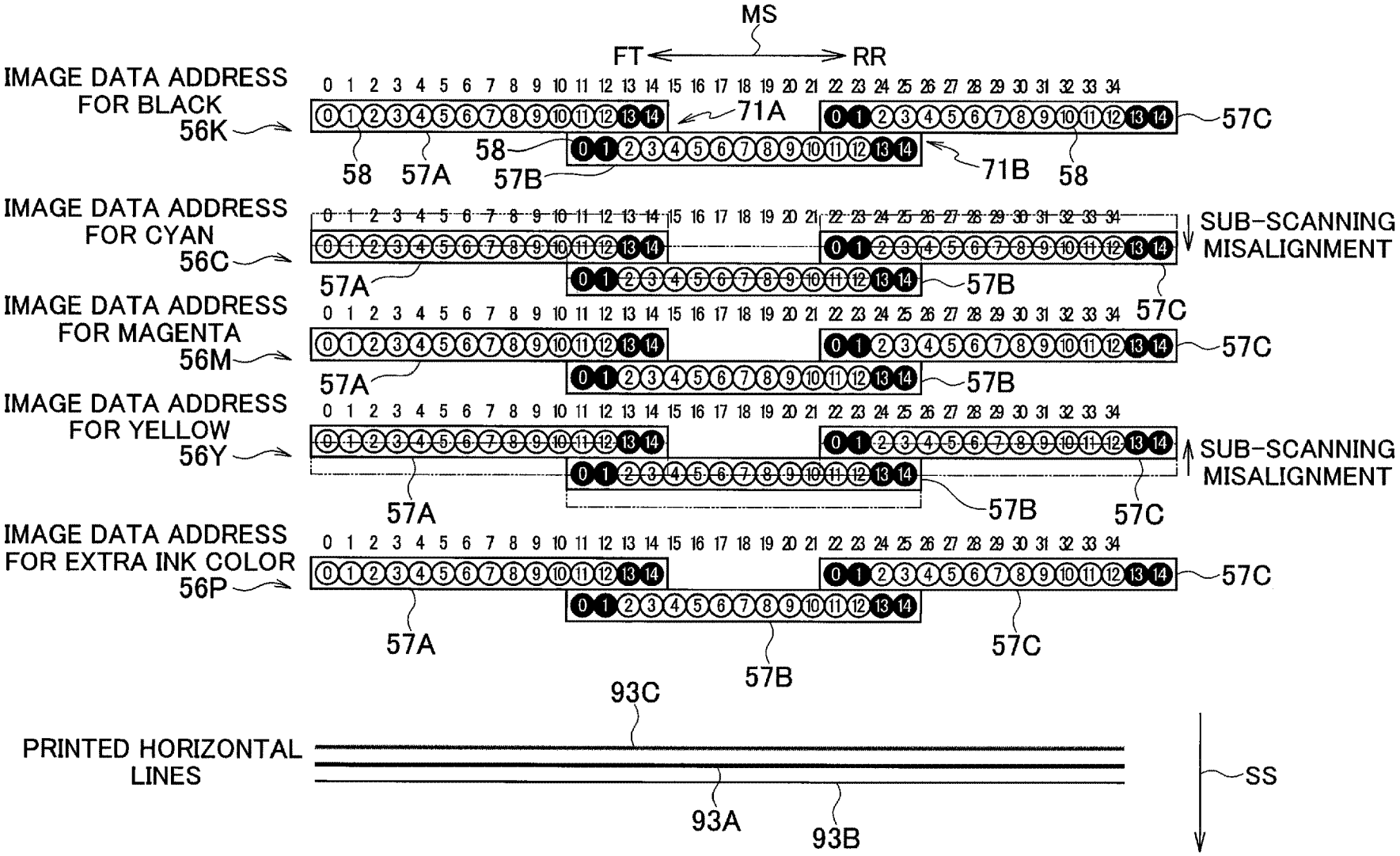
FIG. 28 is a schematic view illustrating an example of a state where the print bars are misaligned in the sub-scanning direction.

FIG. 28 illustrates an example of a state where the print bars 56 are misaligned in the sub-scanning direction unlike in the ideal state as in FIG. 27. In the example of FIG. 28, the position of the print bar 56C is displaced downstream of the proper position illustrated in FIG. 27. Moreover, the position of the print bar 56Y is displaced upstream of the proper position illustrated in FIG. 27.

When the print bars 56 are misaligned in the sub-scanning direction as in FIG. 28, the print image misregistration in the sub-scanning direction occurs if the ink ejection is performed in each print bar 56 at the same timing as that in the ideal state in FIG. 27. The print image quality thereby decreases.

Specifically, for example, when the print bars 56 perform the ink ejection in the state of FIG. 28 at the same timings as in the ideal state of FIG. 27 to print the horizontal line 91 in FIG. 27, horizontal lines 93A to 93C in FIG. 28 are printed. The horizontal line 93A is a line printed by the print bars 56K, 56M, 56P. The horizontal line 93B is a line printed by the print bar 56C. The horizontal line 93C is a line printed by the print bar 56Y.

The horizontal line 93B is printed to be displaced downstream of the horizontal line 93A by an amount corresponding to a downstream displacement amount of the print bar 56C. Meanwhile, the horizontal line 93C is printed to be displaced upstream of the horizontal line 93A by an amount corresponding to an upstream displacement amount of the print bar 56Y. As a result, the straight line 91 to be printed illustrated in FIG. 27 cannot be obtained.

The print bar sub-scanning adjustment processing is processing of reducing a decrease in print image quality caused by the aforementioned misalignment of the print bars 56 in the sub-scanning direction by setting timing adjustment values Tb for ink ejection in the print bars 56.

Figure 29:
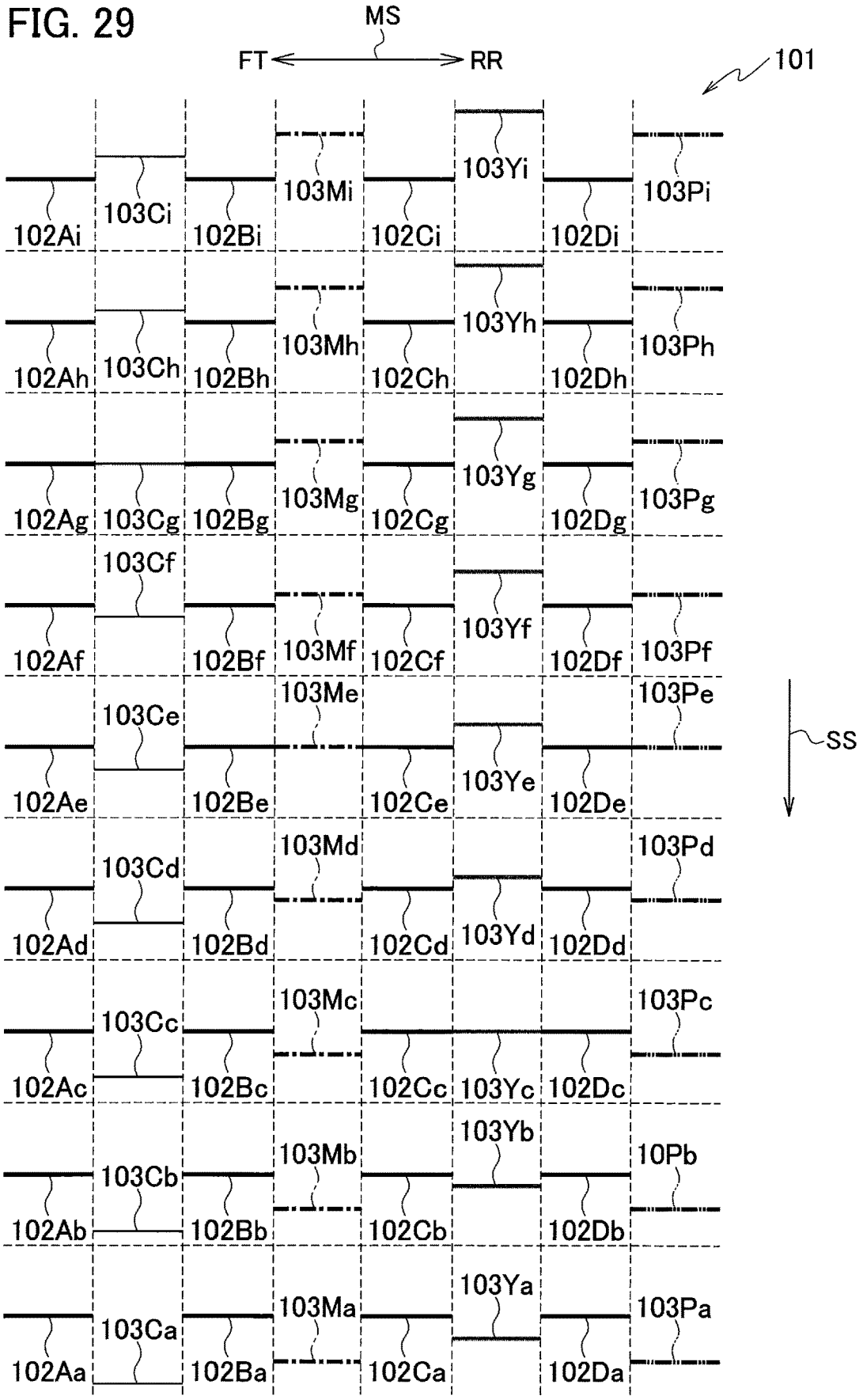
FIG. 29 is a view illustrating an example of a test pattern in print bar sub-scanning adjustment processing.

In the print bar sub-scanning adjustment processing, the printer controller 24 controls the print bars 56 to cause the print bars 56 to print a test pattern 101 illustrated in FIG. 29 while conveying the web W at the predetermined print conveyance speed. The test pattern 101 of FIG. 29 illustrates a pattern printed in a state where the positional relationships among the print bars 56 are those illustrated in FIG. 28. The test pattern 101 includes print bar sub-scanning reference straight lines 102Aa to 102Ai, 102Ba to 102Bi, 102Ca to 102Ci, 102Da to 102Di and print bar sub-scanning adjustment straight lines 103Ca to 103Ci, 103Ma to 103Mi, 103Ya to 103Yi, 103Pa to 103Pi. The printer controller 24 stores the print bar sub-scanning adjustment straight lines 103Ca to 103Ci, 103Ma to 103Mi, 103Ya to 103Yi, 103Pa to 103Pi included in the test pattern 101 in an identifiable manner and also stores the timing adjustment values Tb corresponding to the respective print bar sub-scanning adjustment straight lines 103Ca to 103Ci, 103Ma to 103Mi, 103Ya to 103Yi, 103Pa to 103Pi in, for example, the storage. For example, the printer controller 24 stores the print bar sub-scanning adjustment straight lines 103Ca to 103Ci, 103Ma to 103Mi, 103Ya to 103Yi, 103Pa to 103Pi, pieces of identification information (for example, IDs) corresponding to the respective lines 103Ca to 103Ci, 103Ma to 103Mi, 103Ya to 103Yi, 103Pa to 103Pi, and the timing adjustment values Tb corresponding the respective lines 103Ca to 103Ci, 103Ma to 103Mi, 103Ya to 103Yi, 103Pa to 103Pi as a correspondence table in the storage. Moreover, the pieces of identification information (for example, IDs) corresponding to the respective print bar sub-scanning adjustment straight lines 103Ca to 103Ci, 103Ma to 103Mi, 103Ya to 103Yi, 103Pa to 103Pi may be printed together with the lines 103Ca to 103Ci, 103Ma to 103Mi, 103Ya to 103Yi, 103Pa to 103Pi in the test pattern 101.

The print bar sub-scanning reference straight lines 102 are straight lines extending in the main scanning direction and printed by a sub-scanning reference print bar which is one of the print bars 56K, 56C, 56M, 56Y, 56P. In this example, the print bar 56K is assumed to be the sub-scanning reference print bar. Thus, the print bar sub-scanning reference straight lines 102 are printed by the print bar 56K.

The print bar sub-scanning reference straight lines 102Aa to 102Ai are printed at predetermined intervals in the sub-scanning direction to have a predetermined length. The print bar sub-scanning reference straight lines 102Ba to 102Bi are arranged at the same position as the print bar sub-scanning reference straight lines 102Aa to 102Ai in the sub-scanning direction, respectively. The print bar sub-scanning reference straight lines 102Ca to 102Ci and 102Da to 102Di are also arranged in the same manner.

The print bar sub-scanning reference straight lines 102Ba to 102Bi are printed behind the print bar sub-scanning reference straight lines 102Aa to 102Ai at predetermined intervals in the main scanning direction. The print bar sub-scanning reference straight lines 102Ca to 102Ci are printed behind the print bar sub-scanning reference straight lines 102Ba to 102Bi at predetermined intervals in the main scanning direction. The print bar sub-scanning reference straight lines 102Da to 102Di are printed behind the print bar sub-scanning reference straight lines 102Ca to 102Ci at predetermined intervals in the main scanning direction.

The print bar sub-scanning adjustment straight lines 103Ca to 103Ci are straight lines extending in the main scanning direction and printed by the print bar 56C. The print bar sub-scanning adjustment straight lines 103Ca to 103Ci are printed between the print bar sub-scanning reference straight lines 102Aa to 102Ai and the print bar sub-scanning reference straight lines 102Ba to 102Bi not to overlap them in the main scanning direction.

The print bar sub-scanning adjustment straight lines 103Ma to 103Mi are straight lines extending in the main scanning direction and printed by the print bar 56M. The print bar sub-scanning adjustment straight lines 103Ma to 103Mi are printed between the print bar sub-scanning reference straight lines 102Ba to 102Bi and the print bar sub-scanning reference straight lines 102Ca to 102Ci not to overlap them in the main scanning direction.

The print bar sub-scanning adjustment straight lines 103Ya to 103Yi are straight lines extending in the main scanning direction and printed by the print bar 56Y. The print bar sub-scanning adjustment straight lines 103Ya to 103Yi are printed between the print bar sub-scanning reference straight lines 102Ca to 102Ci and the print bar sub-scanning reference straight lines 102Da to 102Di not to overlap them in the main scanning direction.

The print bar sub-scanning adjustment straight lines 103Pa to 103Pi are straight lines extending in the main scanning direction and printed by the print bar 56P. The print bar sub-scanning adjustment straight lines 103Pa to 103Pi are printed behind and adjacent to the print bar sub-scanning reference straight lines 102Da to 102Di not to overlap the print bar sub-scanning reference straight lines 102Da to 102Di in the main scanning direction.

The print bar sub-scanning adjustment straight lines 103 are printed by each of the print bars 56 (sub-scanning non-reference print bars) other than the print bar 56K which is the sub-scanning reference print bar at timings corresponding to multiple timing adjustment values Tb.

In the example of FIG. 29, the print bar sub-scanning adjustment straight lines 103Ca to 103Ci correspond to nine timing adjustment values Tb1 to Tb9, respectively. This also applies to the print bar sub-scanning adjustment straight lines 103Ma to 103Mi, 103Ya to 103Yi, 103Pa to 103Pi.

The timing adjustment values Tb1 to Tb9 are adjustment values for adjusting a print timing per main scanning line in each of the print bars 56 other than the print bar 56K which is the sub-scanning reference print bar, with respect to a reference timing per main scanning line in each of the print bars 56 other than the print bar 56K.

The reference timing in each of the print bars 56 other than the print bar 56K is a print timing at which each of the print bars 56 other than the print bar 56K in the printer 22 prints a line along the same main scanning line as the print bar 56K when the print bar 56 is not misaligned in the sub-scanning direction.

The print bar sub-scanning adjustment straight lines 103Ca to 103Ci are printed at timings adjusted based on the timing adjustment values Tb1 to Tb9 from the reference timings of the print bar 56C corresponding to the print timings of the print bar sub-scanning reference straight lines 102Aa to 102Ai.

The print bar sub-scanning adjustment straight lines 103Ma to 103Mi are printed at timings adjusted based on the timing adjustment values Tb1 to Tb9 from the reference timings of the print bar 56M corresponding to the print timings of the print bar sub-scanning reference straight lines 102Ba to 102Bi.

The print bar sub-scanning adjustment straight lines 103Ya to 103Yi are printed at timings adjusted based on the timing adjustment values Tb1 to Tb9 from the reference timings of the print bar 56C corresponding to the print timings of the print bar sub-scanning reference straight lines 102Ca to 102Ci.

The print bar sub-scanning adjustment straight lines 103Pa to 103Pi are printed at timings adjusted based on the timing adjustment values Tb1 to Tb9 from the reference timings of the print bar 56P corresponding to the print timings of the print bar sub-scanning reference straight lines 102Da to 102Di.

The timing adjustment value Tb5 is a value which sets the print timings of the print bars 56C, 56M, 56Y, 56P to the same timings as the reference timings thereof and the timing adjustment value Tb5 is "0." In the example of FIG. 29, the print bar sub-scanning adjustment straight lines 103Ce, 103Me, 103Ye, 103Pe are lines printed at the same timings as the reference timings corresponding to the timing adjustment value Tb5.

In the example of FIG. 28, the print bar 56C is displaced downstream of its proper position. Accordingly, the print bar sub-scanning adjustment straight line 103Ce printed by the print bar 56C with the timing adjustment value Tb5 is printed downstream of the print bar sub-scanning reference straight line 102Ae, by an amount corresponding to a downstream displacement amount of the print bar 56C.

Moreover, in the example of FIG. 28, the print bar 56Y is displaced upstream of its proper position. Accordingly, the print bar sub-scanning adjustment straight line 103Ye printed by the print bar 56Y with the timing adjustment value Tb5 is printed upstream of the print bar sub-scanning reference straight line 102Ce, by an amount corresponding to an upstream displacement amount of the print bar 56Y.

The timing adjustment values Tb1 to Tb4 are values for setting the print timings of the print bars 56 earlier than the reference timings. Accordingly, for example, a positional relationship between each of the print bar sub-scanning adjustment straight lines 103Ca to 103Cd corresponding to the timing adjustment values Tb1 to Tb4 and the print bar sub-scanning reference straight line 102 corresponding to the print bar sub-scanning adjustment straight line 103 is such that the print bar sub-scanning adjustment straight line 103 is printed to be displaced downstream compared to the print bar sub-scanning adjustment straight line 103Ce corresponding to the timing adjustment value Tb5.

The timing adjustment values Tb6 to Tb9 are values for setting the print timings of the print bars 56 later than the reference timings. Accordingly, for example, a positional relationship between each of the print bar sub-scanning adjustment straight lines 103Cf to 103Ci corresponding to the timing adjustment values Tb6 to Tb9 and the print bar sub-scanning reference straight line 102 corresponding to the print bar sub-scanning adjustment straight line 103 is such that the print bar sub-scanning adjustment straight line 103 is printed to be displaced upstream compared to the print bar sub-scanning adjustment straight line 103Ce corresponding to the timing adjustment value Tb5.

The timing adjustment values Tb1 to Tb9 are each set such that an amount of change in the print misalignment amount of the print bar sub-scanning adjustment straight line 103 with respect to the print bar sub-scanning reference straight line 102 in the case where the timing adjustment value Tb is changed by one step is great enough to be visually recognized by a human.

The printing of the test pattern 101 in the print bar sub-scanning adjustment processing is performed with the results of the aforementioned print head sub-scanning adjustment processing and the seam portion adjustment processing set. In this case, the print timing of each print bar 56 is controlled as the print timing of the print head 57A which is the reference print head in the print bar 56.

The worker visually checks the test pattern 101 printed on the web W. From the multiple print bar sub-scanning adjustment straight lines 103 printed by each of the print bars 56 other than the print bar 56K, the worker selects the print bar sub-scanning adjustment straight line 103 with the smallest print misalignment amount in the sub-scanning direction with respect to the print bar sub-scanning reference straight line 102 corresponding to each print bar sub-scanning adjustment straight line 103.

Then, the worker performs an input operation of specifying the print bar sub-scanning adjustment straight line 103 with the smallest print misalignment amount in the sub-scanning direction with respect to the print bar sub-scanning reference straight line 102 for each of the print bars 56 other than the print bar 56K, on the operation panel 23. This input operation includes, for example, specifying the identification information (for example, ID) of any of the print bar sub-scanning adjustment straight lines 103Ca to 103Ci, 103Ma to 103Mi, 103Ya to 103Yi, 103Pa to 103Pi printed in the test pattern 101. Note that the information to be specified is not limited to the IDs and may be any information by which the print bar sub-scanning adjustment straight lines 103Ca to 103Ci, 103Ma to 103Mi, 103Ya to 103Yi, 103Pa to 103Pi can be identified. The operation panel 23 outputs print bar adjustment straight line specifying information for each of the print bars 56 other than the print bar 56K to the printer controller 24 based on this input operation. The print bar adjustment straight line specifying information is information specifying the print bar sub-scanning adjustment straight line 103 with the smallest print misalignment amount with respect to the print bar sub-scanning reference straight line 102 in the sub-scanning direction and is, for example, the ID.

When the printer controller 24 receives the print bar sub-scanning adjustment straight line specifying information for each of the print bars 56 other than the print bar 56K, the printer controller 24 sets (determines) the timing adjustment value Tb corresponding to the print bar sub-scanning adjustment straight line 103 specified by the print bar sub-scanning adjustment straight line specifying information, as the timing adjustment value Tb of the ink ejection in the print bar 56 in the normal printing. For example, when the printer controller 24 receives the identification information (for example, the ID) which is the print bar sub-scanning adjustment straight line specifying information for each of the print bars 56 other than the print bar 56K, the printer controller 24 refers to the correspondence table for each of the print bars 56 other than the print bar 56K to determine the timing adjustment value Tb corresponding to the identification information (for example, the ID) and sets the determined timing adjustment value Tb as the timing adjustment value Tb of the ink ejection in the print bar 56.

In the example of FIGS. 28 and 29, the print bar sub-scanning adjustment straight line 103Cg among the print bar sub-scanning adjustment straight lines 103Ca to 103Ci corresponding to the print bar 56C has the smallest print misalignment amount in the sub-scanning direction with respect to the print bar sub-scanning reference straight line 102. Accordingly, the timing adjustment value Tb7 corresponding to the print bar sub-scanning adjustment straight line 103Cg is set as the timing adjustment value Tb of the ink ejection in the print bar 56C.

Moreover, the print bar sub-scanning adjustment straight line 103Me among the print bar sub-scanning adjustment straight lines 103Ma to 103Mi corresponding to the print bar 56M has the smallest print misalignment amount in the sub-scanning direction with respect to the print bar sub-scanning reference straight line 102. Accordingly, the timing adjustment value Tb5 corresponding to the print bar sub-scanning adjustment straight line 103Me is set as the timing adjustment value Tb of the ink ejection in the print bar 56M.

Furthermore, the print bar sub-scanning adjustment straight line 103Yc among the print bar sub-scanning adjustment straight lines 103Ya to 103Yi corresponding to the print bar 56Y has the smallest print misalignment amount in the sub-scanning direction with respect to the print bar sub-scanning reference straight line 102. Accordingly, the timing adjustment value Tb3 corresponding to the print bar sub-scanning adjustment straight line 103Yc is set as the timing adjustment value Tb of the ink ejection in the print bar 56Y.

Moreover, the print bar sub-scanning adjustment straight line 103Pe among the print bar sub-scanning adjustment straight lines 103Pa to 103Pi corresponding to the print bar 56P has the smallest print misalignment amount in the sub-scanning direction with respect to the print bar sub-scanning reference straight line 102. Accordingly, the timing adjustment value Tb5 corresponding to the print bar sub-scanning adjustment straight line 103Pe is set as the timing adjustment value Tb of the ink ejection in the print bar 56P.

When the timing adjustment values Tb of the ink ejection for the respective print bars 56C, 56M, 56Y, 56P other than the print bar 56K are set, the print bar sub-scanning adjustment processing is terminated.

Next, in step S4 of FIG. 4, the printer controller 24 executes the print bar main scanning adjustment processing. The print bar main scanning adjustment processing is processing of adjusting misalignment of the print bars 56 in the main scanning direction.

Figure 30:
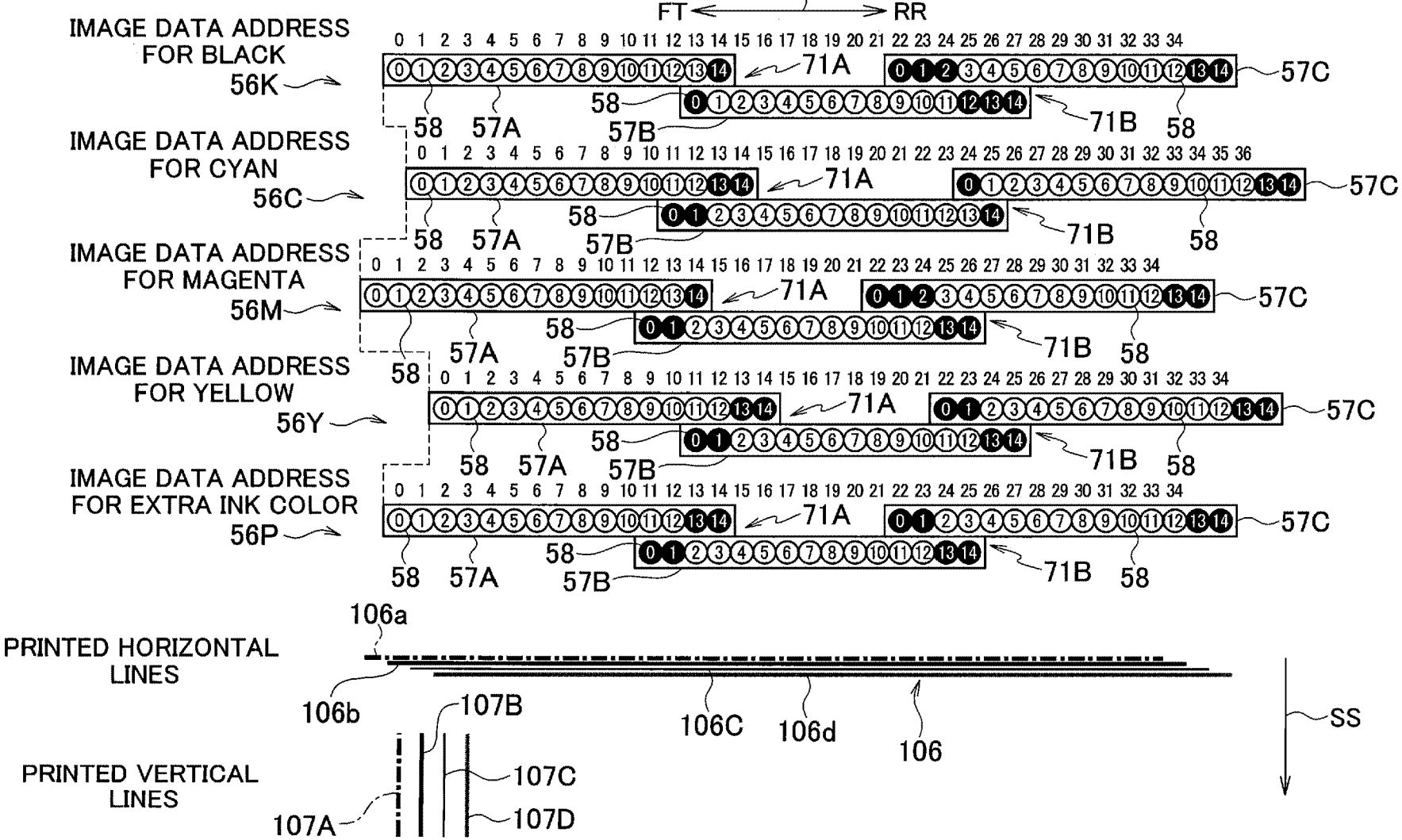
FIG. 30 is a schematic view illustrating an example of a state where the print bars are misaligned in the main scanning direction.

FIG. 30 illustrates an example of the state where the print bars 56 are misaligned in the main scanning direction with respect to the ideal state in FIG. 27. In the example of FIG. 30, front ends of the print bars 56C, 56Y are displaced rearward with respect to the print bars 56K, 56P. The front end of the print bar 56Y is further displaced rearward with respect to the print bar 56C. Moreover, a front end of the print bar 56M is displaced forward with respect to the print bars 56K, 56P.

Note that, in the example of FIG. 30, the print bars 56K, 56C, 56M are in a state where the print heads 57 are misaligned in the main scanning direction in the print bars 56. The nozzles to be used in the overlap regions 71A, 71B are set in the aforementioned seam portion adjustment processing.

When the printing is performed in the state of FIG. 30 with correspondence relationships of the nozzles 58 in the print bars 56 set as the same as those in the state where the print bars 56 are not misaligned in the main scanning direction, misregistration of the print image in the main scanning direction occurs. The print image quality thereby decreases.

Specifically, when the print bars 56 perform the ink ejection to print, for example, the same lines as the horizontal line 91 in FIG. 27 in the state of FIG. 30 under assumption that the nozzles 58 located at the same position from the front side of the print bars 56 are in charge of the same pixels, a horizontal line 106 is printed.

In the horizontal line 106, color misregistration in the main scanning direction occurs due to misalignment of the print bars 56K, 56C, 56M, 56Y, 56P in the main scanning direction. Note that, in the horizontal line 106 of FIG. 30, horizontal lines 106*a* to 106*d* of the respective colors are illustrated to be shifted from one another in the sub-scanning direction for the sake of illustration. The horizontal line 106*a* is magenta, the horizontal line 106*b* is black and the extra ink color, the horizontal line 106*c* is cyan, and the horizontal line 106*d* is yellow.

Moreover, for example, when the print bars 56 perform the ink ejection to print the same lines as the vertical line 92 in FIG. 27 in the state of FIG. 30 under assumption that the nozzles 58 located at the same position from the front side of the print bars 56 are in charge of the same pixels, vertical lines 107A to 107D are printed. The vertical line 107A is printed in magenta, the vertical line 107B is printed in black and the extra ink color, the vertical line 107C is printed in cyan, and the vertical line 107D is printed in yellow. The vertical lines 107A to 107D are printed away from one another in the main scanning direction due to the misalignment of the print bars 56K, 56C, 56M, 56Y, 56P in the main scanning direction.

The print bar main scanning adjustment processing is processing of reducing a decrease in print image quality caused by the aforementioned misalignment of the print bars 56 in the main scanning direction by setting correspondence relationships of the nozzles 58 among the print bars 56 depending on the misalignment of the print bars 56 in the main scanning direction.

In the print bar main scanning adjustment processing, the printer controller 24 causes the print bars 56 to print position determination straight lines extending in the sub-scanning direction as a test pattern on the web W by using the nozzles 58 located at the same position from the front side in the respective print bars 56, while conveying the web W.

Figure 31:
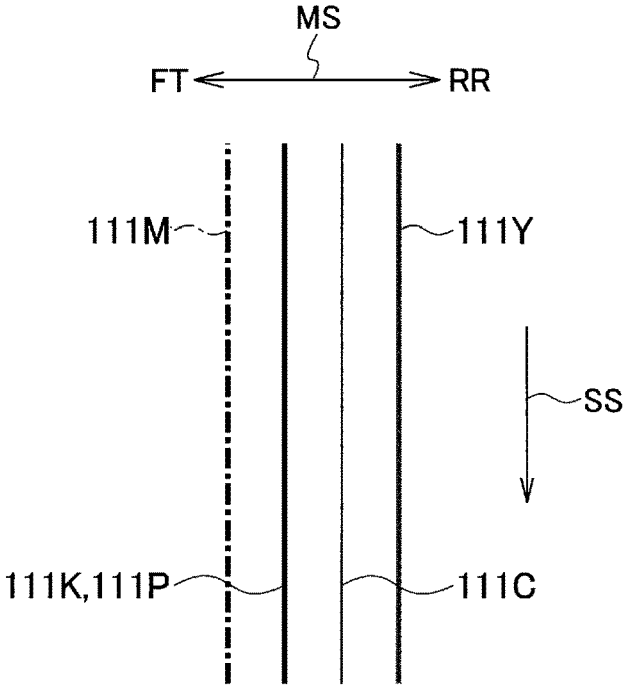
FIG. 31 is a view illustrating an example of position determination straight lines in print bar main scanning adjustment processing.

For example, in the state of FIG. 30, the printer controller 24 causes the nozzles 58 with the nozzle number N=0 in the print heads 57A of the print bars 56K, 56C, 56M, 56Y, 56P to print position determination straight lines 111K, 111C, 111M, 111Y, 111P, respectively, as illustrated in FIG. 31.

The position determination straight lines 111K, 111C, 111M, 111Y, 111P are printed at positions corresponding to the positions of the front ends of the print bars 56K, 56C, 56M, 56Y, 56P in the main scanning direction. In the example of FIG. 30, there is no misalignment between the print bars 56K, 56P in the main scanning direction and the position determination straight line 111K and the position determination straight line 111P are thus printed at the same position.

When the printing of the position determination straight lines 111 is completed, the worker visually checks the position determination straight lines 111 printed on the web W. The worker selects one of the position determination straight lines 111K, 111C, 111M, 111Y, 111P which is printed farthest to the rear.

Next, the worker performs an input operation of specifying the position determination straight line 111 printed farthest to the rear, on the operation panel 23. This input operation includes, for example, specifying the identification information (for example, ID) of any of the position determination straight lines 111K, 111C, 111M, 111Y, 111P. Note that the information to be specified is not limited to the ID and may be any information by which the position determination straight lines 111K, 111C, 111M, 111Y, 111P can be identified. The operation panel 23 outputs position determination straight line specifying information to the printer controller 24 based on this input operation. The position determination straight line specifying information is information specifying the position determination straight line 111 printed farthest to the rear and is, for example, the ID. Note that the printer controller 24 stores the position determination straight lines 111K, 111C, 111M, 111Y, 111P in an identifiable manner and also stores the nozzles 58 for printing the respective position determination straight lines 111K, 111C, 111M, 111Y, 111P in, for example, the storage. For example, the printer controller 24 stores the position determination straight lines 111K, 111C, 111M, 111Y, 111P, the pieces of identification information (for example, IDs) corresponding to these lines 111K, 111C, 111M, 111Y, 111P, and the nozzles 58 corresponding to these lines 111K, 111C, 111M, 111Y, 111P as a correspondence table in the storage. Moreover, the pieces of the identification information (for example, ID) may be printed together with the position determination straight lines 111K, 111C, 111M, 111Y, 111P.

When the printer controller 24 receives the position determination straight line specifying information, the printer controller 24 sets (determines) the print bar 56 having printed the specified position determination straight line 111 as a main scanning reference print bar. The print bar 56 with the front end displaced farthest to the rear is thus set as the main scanning reference print bar. Moreover, the printer controller 24 sets one of the nozzles 58 of the print bar 56 set as the main scanning reference print bar as a reference nozzle. For example, when the printer controller 24 receives the identification information (for example, ID) which is position determination information, the printer controller 24 refers to the correspondence table to determine the print bar 56 corresponding to the identification information (for example, ID). Then, the printer controller 24 sets the determined print bar 56 as the main scanning reference print bar.

In the examples of FIGS. 30 and 31, the position determination straight line 111Y is the line printed farthest to the rear and the print bar 56Y is set as the main scanning reference print bar. Moreover, for example, the nozzle 58 with the nozzle number N=0 in the print bar 56Y is set as the reference nozzle.

Next, the printer controller 24 causes the main scanning reference print bar to print the print bar main scanning reference straight line on the web W as a test pattern 301 by using the reference nozzle in the main scanning reference print bar while conveying the web W and also causes the print bars 56 (main scanning non-reference print bars) other than the main scanning reference print bar to print print bar main scanning adjustment straight lines by using the nozzles 58 located at the same position as the reference nozzle from the front side in the main scanning direction in the print bars 56.

Figure 32:
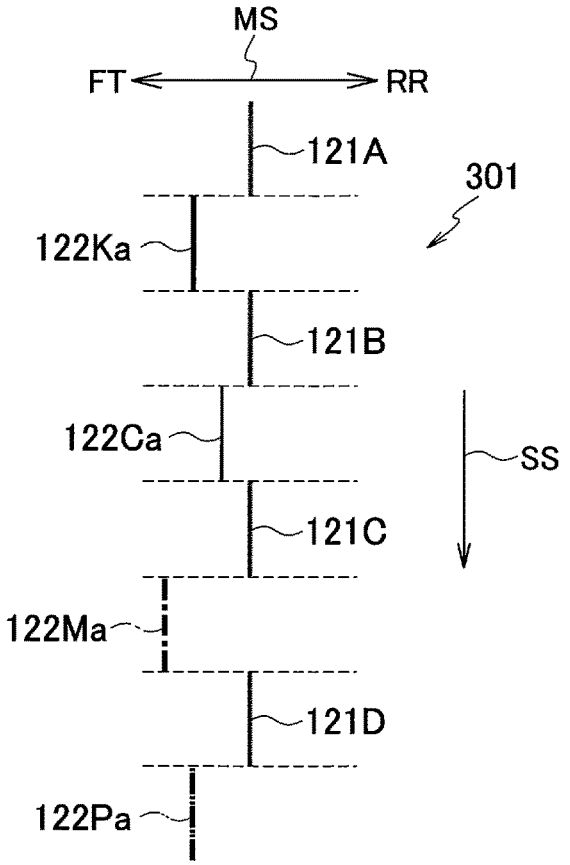
FIG. 32 is an explanatory view of print bar main scanning reference straight lines and print bar main scanning adjustment straight lines in the print bar main scanning adjustment processing.

For example, in the state of FIG. 30, the printer controller 24 causes the print bar 56Y which is the main scanning reference print bar to print print bar main scanning reference straight lines 121A to 121D illustrated in FIG. 32 by using the nozzle 58 with the nozzle number N=0. The print bar main scanning reference straight lines 121 are straight lines extending in the sub-scanning direction. The print bar main scanning reference straight lines 121A to 121D are printed at predetermined intervals in the sub-scanning direction to have predetermined length.

Moreover, the printer controller 24 causes the print bars 56K, 56C, 56M, 56P to print the print bar main scanning adjustment straight lines 122Ka, 122Ca, 122Ma, 122Pa, respectively, by using the nozzles 58 with the nozzle number N=0. The print bar main scanning adjustment straight lines 122 are straight lines extending in the sub-scanning direction.

The print bar main scanning adjustment straight line 122Ka is printed between the print bar main scanning reference straight lines 121A, 121B in the sub-scanning direction not to overlap the print bar main scanning reference straight lines 121A, 121B.

The print bar main scanning adjustment straight line 122Ca is printed between the print bar main scanning reference straight lines 121B, 121C in the sub-scanning direction not to overlap the print bar main scanning reference straight lines 121B, 121C.

The print bar main scanning adjustment straight line 122Ma is printed between the print bar main scanning reference straight lines 121C, 121D in the sub-scanning direction not to overlap the print bar main scanning reference straight lines 121C, 121D.

The print bar main scanning adjustment straight line 122Pa is printed adjacent to and downstream of the print bar main scanning reference straight line 121D in the sub-scanning direction not to overlap the print bar main scanning reference straight line 121D.

Then, the printer controller 24 performs control such that an operation as follows is repeated a specified number Q of times: the main scanning reference print bar prints the print bar main scanning reference straight lines 121 by using the reference nozzle and each of the print bars 56 other than the main scanning reference print bar prints the print bar main scanning adjustment straight lines 122 with the nozzle 58 to be used shifted to one nozzle behind each time.

Figure 33:
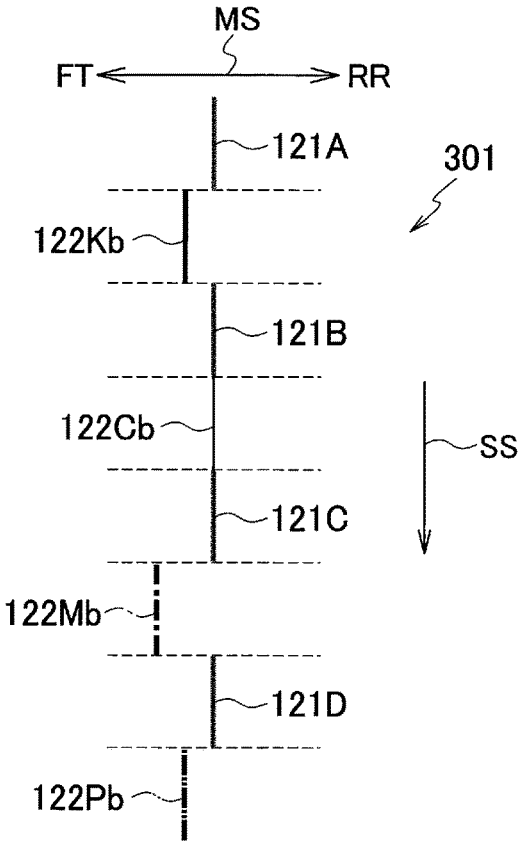
FIG. 33 is an explanatory view of the print bar main scanning reference straight lines and the print bar main scanning adjustment straight lines in the print bar main scanning adjustment processing.

For example, after the printing of the print bar main scanning reference straight lines 121A to 121D and the print bar main scanning adjustment straight lines 122Ka, 122Ca, 122Ma, 122Pa in FIG. 32 by the print bars 56 in the state of FIG. 30, as illustrated in FIG. 33, the printer controller 24 causes the print bar 56Y to print the print bar main scanning reference straight lines 121A to 121D as the test pattern 301 by using the nozzle 58 with the nozzle number N=0 and also causes the print bars 56K, 56C, 56M, 56P to print the print bar main scanning adjustment straight lines 122Kb, 122Cb, 122Mb, 122Pb by using the nozzles 58 with the nozzle number N=1.

The print bar main scanning adjustment straight lines 122Kb, 122Cb, 122Mb, 122Pb are lines obtained by shifting the print bar main scanning adjustment straight lines 122Ka, 122Ca, 122Ma, 122Pa rearward by an amount corresponding to one pitch of the nozzles 58.

Figure 34:
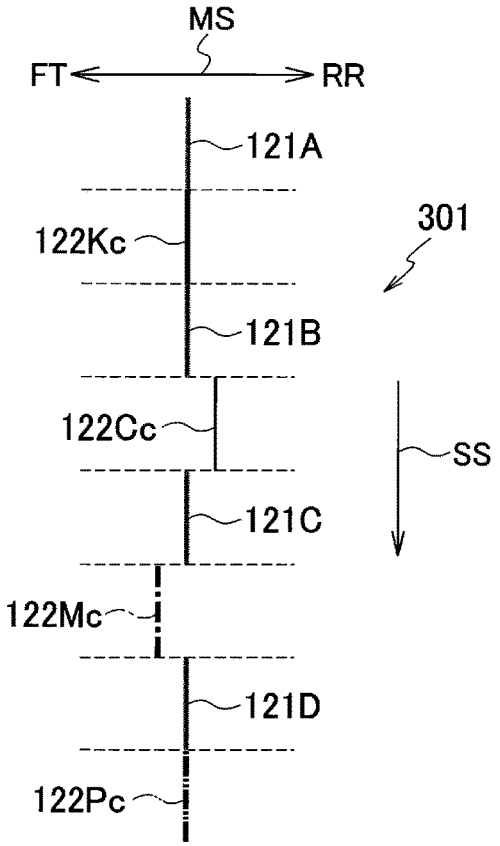
FIG. 34 is an explanatory view of the print bar main scanning reference straight lines and the print bar main scanning adjustment straight lines in the print bar main scanning adjustment processing.
Figure 35:
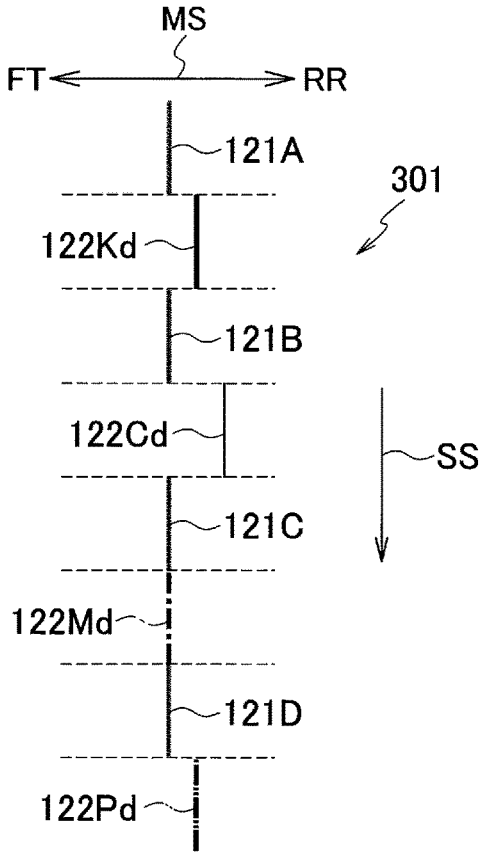
FIG. 35 is an explanatory view of the print bar main scanning reference straight lines and the print bar main scanning adjustment straight lines in the print bar main scanning adjustment processing.
Figure 36:
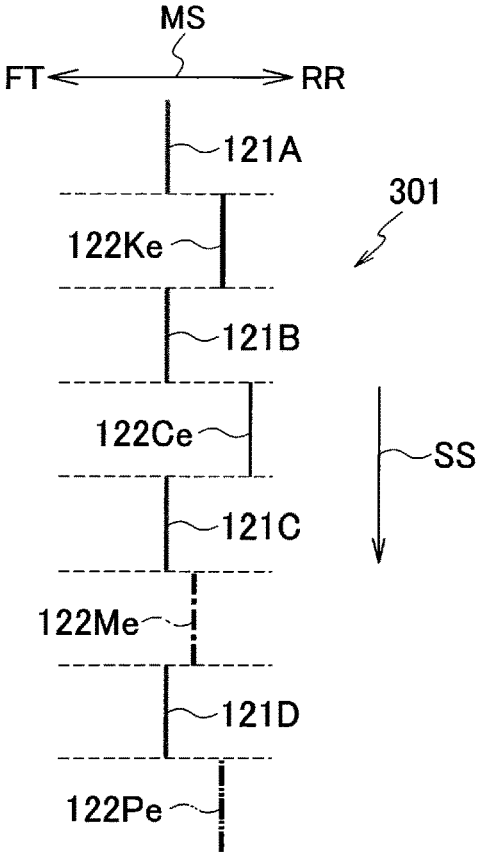
FIG. 36 is an explanatory view of the print bar main scanning reference straight lines and the print bar main scanning adjustment straight lines in the print bar main scanning adjustment processing.

Hereafter, as illustrated in FIGS. 34 to 36, the printer controller 24 causes the print bar 56Y to print the print bar main scanning reference straight lines 121A to 121D by using the nozzle 58 with the nozzle number N=0 and causes the print bars 56K, 56C, 56M, 56P to print the print bar main scanning adjustment straight lines 122Kc to Ke, 122Cc to 122Ce, 122Mc to Me, 122Pc to Pe, as the test pattern 301, with the nozzle 58 to be used shifted to one nozzle behind each time. The printer controller 24 stores the print bar main scanning adjustment straight lines 122Ka to Ke, 122Ca to 122Ce, 122Ma to Me, 122Pa to Pe included in the test pattern 301 in an identifiable manner and also stores the nozzles 58 for printing the respective print bar main scanning adjustment straight lines 122Ka to Ke, 122Ca to 122Ce, 122Ma to Me, 122Pa to Pe in, for example, the storage. For example, the printer controller 24 stores combinations of the print bar main scanning adjustment straight lines 122Ka to Ke, 122Ca to 122Ce, 122Ma to Me, 122Pa to Pe, the pieces of identification information (for example, IDs) corresponding to the lines 122Ka to Ke, 122Ca to 122Ce, 122Ma to Me, 122Pa to Pe, and the nozzles 58 corresponding to the lines 122Ka to Ke, 122Ca to 122Ce, 122Ma to Me, 122Pa to Pe in the storage as a correspondence table. Moreover, the pieces of identification information (for example, IDs) of the print bar main scanning adjustment straight lines 122Ka to Ke, 122Ca to 122Ce, 122Ma to Me, 122Pa to Pe may be printed in the test pattern 301 together with the lines 122Ka to Ke, 122Ca to 122Ce, 122Ma to Me, 122Pa to Pe.

In the example of FIGS. 32 to 36, the aforementioned specified number Q is four. The specified number Q is set in advance depending on a conceivable misalignment amount of the print bars 56 in the main scanning direction.

The printing of the position determination straight lines 111, the print bar main scanning reference straight lines 121, and the print bar main scanning adjustment straight lines 122 in the print bar main scanning adjustment processing is performed with the results of the aforementioned print head sub-scanning adjustment processing, the seam portion adjustment processing, and the print bar sub-scanning adjustment processing set.

The worker visually checks a pattern image including the print bar main scanning reference straight lines 121 and the print bar main scanning adjustment straight lines 122 printed on the web W as illustrated in FIGS. 32 to 36. The worker selects the print bar main scanning adjustment straight line 122 with the smallest print misalignment amount in the main scanning direction with respect to the print bar main scanning reference straight lines 121 for each of the print bars 56 other than the main scanning reference print bar.

Then, the worker performs an input operation of specifying the print bar main scanning adjustment straight line 122 with the smallest print misalignment amount in the main scanning direction with respect to the print bar main scanning reference straight lines 121 for each of the print bars 56 other than the main scanning reference print bar, on the operation panel 23. This input operation includes, for example, specifying the identification information (for example, ID) of any of the print bar main scanning adjustment straight lines 122Ka to Ke, 122Ca to 122Ce, 122Ma to Me, 122Pa to Pe printed in the test pattern 301. Note that the information to be specified is not limited to the IDs and may be any information by which the print bar main scanning adjustment straight lines 122Ka to Ke, 122Ca to 122Ce, 122Ma to Me, 122Pa to Pe can be identified. The operation panel 23 outputs print bar main scanning adjustment straight line specifying information for each of the print bars 56 other than the main scanning reference print bar to the printer controller 24 based on this input operation. The print bar main scanning adjustment straight line specifying information is information specifying the print bar main scanning adjustment straight line 122 with the smallest print misalignment amount in the main scanning direction with respect to the print bar main scanning reference straight lines 121 and is, for example, the ID.

When the printer controller 24 receives the print bar main scanning adjustment straight line specifying information for each of the print bars 56 other than the main scanning reference print bar, the printer controller 24 sets (determines) correspondence relationship of the nozzles between the main scanning reference print bar and each of the print bars 56 other than the main scanning reference print bar in the normal printing to be such a relationship that the nozzle 58 used to print the specified print bar main scanning adjustment straight line 122 and the reference nozzle of the main scanning reference print bar are in charge of the same pixel in the main scanning direction. For example, when the printer controller 24 receives the identification information (for example, ID) which is the print bar main scanning adjustment straight line specifying information for each of the print bars 56 other than the main scanning reference print bar, the printer controller 24 refers to the correspondence table to determine the nozzle 58 corresponding to the identification information (for example, ID) for each of the print bars 56 other than the main scanning reference print bar. Then, the printer controller 24 sets the correspondence relationship of the nozzles between the main scanning reference print bar and each of the print bars 56 other than the main scanning reference print bar to be such a relationship that the specified nozzle 58 and the reference nozzle of the main scanning reference print bar are in charge of the same pixel in the main scanning direction.

In the example of FIGS. 30 to 36, the print bar main scanning adjustment straight line 122Kc among the print bar main scanning adjustment straight lines 122Ka to 122Ke corresponding to the print bar 56K has the smallest print misalignment amount in the main scanning direction with respect to the print bar main scanning reference straight lines 121. Accordingly, the correspondence relationship of the nozzles 58 in the print bar 56K and the print bar 56Y is set to be such a relationship that the nozzle 58 with the nozzle number N=2 in the print bar 56K having printed the print bar main scanning adjustment straight line 122Kc and the nozzle 58 with the nozzle number N=0 in the print bar 56Y are in charge of the same pixel in the main scanning direction.

Figure 37:
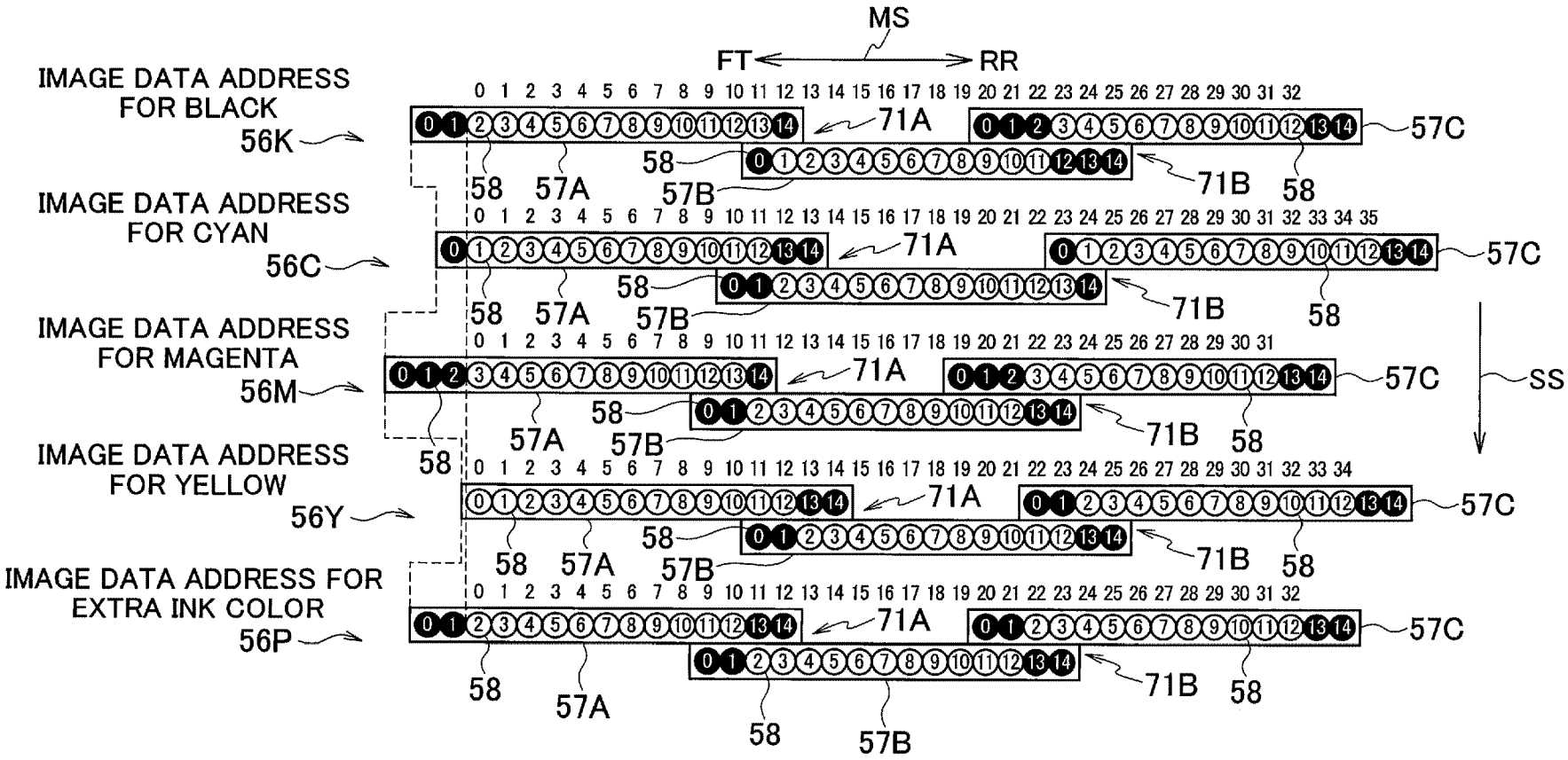
FIG. 37 is an explanatory view of a result of the print bar main scanning adjustment processing.

Moreover, the print bar main scanning adjustment straight line 122Cb among the print bar main scanning adjustment straight lines 122Ca to 122Ce corresponding to the print bar 56C has the smallest print misalignment amount in the main scanning direction with respect to the print bar main scanning reference straight lines 121. Accordingly, as illustrated in FIG. 37, the correspondence relationship of the nozzles 58 between the print bar 56C and the print bar 56Y is set to be such a relationship that the nozzle 58 with the nozzle number N=1 in the print bar 56C having printed the print bar main scanning adjustment straight line 122Cb and the nozzle 58 with the nozzle number N=0 in the print bar 56Y are in charge of the same pixel in the main scanning direction.

Furthermore, the print bar main scanning adjustment straight line 122Md among the print bar main scanning adjustment straight lines 122Ma to 122Me corresponding to the print bar 56M has the smallest print misalignment amount in the main scanning direction with respect to the print bar main scanning reference straight lines 121. Accordingly, as illustrated in FIG. 37, the correspondence relationship of the nozzles 58 between the print bar 56M and the print bar 56Y is set to such a relationship that the nozzle 58 with the nozzle number N=3 in the print bar 56M having printed the print bar main scanning adjustment straight line 122Md and the nozzle 58 with the nozzle number N=0 in the print bar 56Y are in charge of the same pixel in the main scanning direction.

Moreover, the print bar main scanning adjustment straight line 122Md among the print bar main scanning adjustment straight lines 122Ma to 122Me corresponding to the print bar 56M has the smallest print misalignment amount in the main scanning direction with respect to the print bar main scanning reference straight lines 121. Accordingly, as illustrated in FIG. 37, the correspondence relationship of the nozzles 58 in the print bar 56M and the print bar 56Y is set to be such a relationship that the nozzle 58 with the nozzle number N=3 in the print bar 56M having printed the print bar main scanning adjustment straight line 122Md and the nozzle 58 with the nozzle number N=0 in the print bar 56Y are in charge of the same pixel in the main scanning direction.

Furthermore, the print bar main scanning adjustment straight line 122Pc among the print bar main scanning adjustment straight lines 122Pa to 122Pe corresponding to the print bar 56P has the smallest print misalignment amount in the main scanning direction with respect to the print bar main scanning reference straight lines 121. Accordingly, as illustrated in FIG. 37, the correspondence relationship of the nozzles 58 between the print bar 56P and the print bar 56Y is set to be such a relationship that the nozzle 58 with the nozzle number N=2 in the print bar 56P having printed the print bar main scanning adjustment straight line 122Pc and the nozzle 58 with the nozzle number N=0 in the print bar 56Y are in charge of the same pixel in the main scanning direction.

The correspondence relationships of the nozzles 58 depending on the misalignment in the main scanning direction in the print bars 56K, 56C, 56M, 56P are set as described above. The print bar main scanning adjustment processing is thus terminated. As a result, the print adjustment operation in the inkjet printer 3 is terminated.

Hereafter, the printing (normal printing) operation on the web W based on a print job is performed with the results of the print head sub-scanning adjustment processing, the seam portion adjustment processing, the print bar sub-scanning adjustment processing, and the print bar main scanning adjustment processing in the aforementioned print adjustment operation set for the printers 22A, 22B.

As described above, in the inkjet printer 3, in the print head sub-scanning adjustment processing, the printer controller 24 causes the print heads 57 to print the test pattern 81 including the head reference straight line 82 printed by one of the print heads 57 which is the reference print head and the head adjustment straight lines 83 printed by the print heads 57 other than the reference print head. Then, when the printer controller 24 receives the head adjustment straight line specifying information specifying the head adjustment straight line 83 with the smallest print misalignment amount in the sub-scanning direction with respect to the head reference straight line 82 for each of the print heads 57 other than the reference print head by the input operation of the worker, the printer controller 24 sets the timing adjustment value Th corresponding to the specified head adjustment straight line 83 as the timing adjustment value Th of the ink ejection in the print head 57.

Since the print heads 57 are arranged in the main scanning direction in each print bar 56, the head reference straight line 82 and the head adjustment straight lines 83 are printed such that at least portions thereof do not overlap one another in the main scanning direction. Moreover, the head adjustment straight lines 83 printed by the different print heads 57 are printed such that at least portions thereof do not overlap one another in the main scanning direction.

Thus, the worker can easily visually check the print misalignment amount in the sub-scanning direction between the head reference straight line 82 and each of the head adjustment straight lines 83 without using a scanner. This can reduce occurrence of the case where improper values are set as the timing adjustment values Th in the print heads 57 other than the reference print head, without the use of the scanner. As a result, it is possible to reduce the decrease in print image quality caused by the misalignment of the nozzles 58 due to misalignment of the print heads 57 in the print bars 56 in the sub-scanning direction while avoiding the use of the scanner for adjustment of the misalignment of the nozzles 58.

Moreover, in the inkjet printer 3, in the seam portion adjustment processing, the printer controller 24 causes each pair of print heads 57 adjacent to each other in the main scanning direction to print the front seam portion adjustment straight line 86 on the web W by using the specified number L of the nozzles 58 from the overlap region side (rear) end of the front (one) print head 57 and to also print the rear seam portion adjustment straight line 87 on the web W by using the specified number L of the nozzles from the overlap region side (front) end of the rear (other) print head 57.

Thereafter, the printer controller 24 causes the print heads 57 adjacent to each other in the main scanning direction to perform the operation the specified number M of times while the front print head 57 and the rear print head 57 of the adjacent print heads 57 alternately reduce the number of the nozzles 58 to be used by one from the overlap region side each time, the operation being an operation in which the front print head 57 prints the front seam portion adjustment straight line 86 and the rear print head 57 prints the rear seam portion adjustment straight line 87.

Then, when the printer controller 24 receives the seam portion adjustment straight line specifying information specifying the combination of the seam portion adjustment straight lines 86, 87 which forms no gap between the seam portion adjustment straight lines 86, 87 in the main scanning direction and which has the smallest overlapping portion between the seam portion adjustment straight lines 86, 87 for each overlap region 71 by the input operation of the worker, the printer controller 24 sets the nozzles 58 used in the front print head 57 and the rear print head 57 in the overlap region 71 in the printing of the combination of the seam portion adjustment straight lines 86, 87 specified by the seam portion adjustment straight line specifying information, as the nozzles to be used in the overlap region 71.

In this case, since the seam portion adjustment straight lines 86, 87 are shifted from each other in the sub-scanning direction, the worker can easily visually check the overlapping portion in the main scanning direction without using the scanner. This can reduce occurrence of the case where the nozzles to be used in the overlap region 71 are improperly set, without the use of the scanner. As a result, it is possible to reduce the decrease in print image quality caused by the misalignment of the nozzles 58 due to misalignment of the print heads 57 in the print bars 56 in the main scanning direction while avoiding the use of the scanner for adjustment of the misalignment of the nozzles 58.

Moreover, in the inkjet printer 3, in the print bar sub-scanning adjustment processing, the printer controller 24 causes the print bars 56 to print the test pattern 101 including the print bar sub-scanning reference straight lines 102 printed by one of the print bars 56 which is the sub-scanning reference print bar and the print bar sub-scanning adjustment straight lines 103 printed by the print bars 56 other than the sub-scanning reference print bar. In the test pattern 101, each of the print bar sub-scanning adjustment straight lines 103 does not overlap the print bar sub-scanning reference straight lines 102 and the print bar sub-scanning reference straight lines 103 printed by the other print bars 56 in the main scanning direction.

Then, when the printer controller 24 receives the print bar adjustment straight line specifying information specifying the print bar sub-scanning adjustment straight line 103 with the smallest print misalignment amount in the sub-scanning direction with respect to the print bar sub-scanning reference straight line 102 for each of the print bars 56 other than the sub-scanning reference print bar by the input operation of the worker, the printer controller 24 sets the timing adjustment value Tb corresponding to the print bar sub-scanning adjustment straight line 103 specified by the print bar sub-scanning adjustment straight line specifying information for each of the print bars 56 other than the sub-scanning reference print bar, as the timing adjustment value Tb of the ink ejection in this print bar 56.

In this case, in the test pattern 101, the print bar sub-scanning reference straight lines 102 and the print bar sub-scanning adjustment straight lines 103 do not overlap one another in the main scanning direction. Moreover, the print bar sub-scanning reference straight lines 103 printed by the different print bars 56 do not overlap one another in the main scanning direction. Accordingly, the worker can easily visually check the print misalignment amounts in the sub-scanning direction between the print bar sub-scanning reference straight lines 102 and the print bar sub-scanning adjustment straight lines 103 without using the scanner. This can reduce occurrence of the case where an improper value is set as the timing adjustment value Tb in each of the print bars 56 other than the sub-scanning reference print bar, without the use of the scanner. As a result, it is possible to reduce the decrease in print image quality caused by the misalignment of the nozzles 58 due to misalignment of the print bar 56 in the sub-scanning direction while avoiding the use of the scanner for adjustment of the misalignment of the nozzles 58.

Moreover, in the inkjet printer 3, in the print bar main scanning adjustment processing, the printer controller 24 causes one of the print bars 56 which is the main scanning reference print bar to print the print bar main scanning reference straight lines 121 by using the reference nozzle and causes the print bars 56 other than the main scanning reference print bar to print the print bar main scanning adjustment straight lines 122 by using the nozzles 58 located at the same positon as the reference nozzle from the one side (front side) in the main scanning direction in the print bars 56. The print bar main scanning adjustment straight lines 122 do not overlap the print bar main scanning reference straight lines 121 and the print bar main scanning adjustment straight lines 122 printed by the other print bars 56 in the sub-scanning direction.

Thereafter, the printer controller 24 repeats the operation as follows the specified number Q of times: the print bar 56 which is the main scanning reference print bar prints the print bar main scanning reference straight lines 121 by using the reference nozzle and each of the print bars 56 other than the main scanning reference print bar prints the print bar main scanning adjustment straight lines 122 while the nozzle 58 to be used are shifted to the next one on the other side (rear side) each time.

Then, when the printer controller 24 receives the print bar main scanning adjustment straight line specifying information specifying the print bar main scanning adjustment straight line 122 with the smallest print misalignment amount in the main scanning direction with respect to the print bar main scanning reference straight lines 121 for each of the print bars 56 other than the main scanning reference print bar by the input operation of the worker, the printer controller 24 sets the correspondence relationships of the nozzles in the main scanning reference print bar and the print bars 56 other than the main scanning reference print bar to be such relationships that the nozzle 58 used to print the specified print bar main scanning adjustment straight line 122 and the reference nozzle of the main scanning reference print bar are in charge of the same pixel in the main scanning direction.

In this case, the print bar main scanning reference straight lines 121 and the print bar main scanning adjustment straight lines 122 do not overlap one another in the sub-scanning direction. Moreover, the print bar main scanning adjustment straight lines 122 printed by the different print bars 56 also do not overlap one another in the sub-scanning direction. Accordingly, the worker can easily visually check the print misalignment amounts in the main scanning direction between the print bar main scanning reference straight lines 121 and the print bar main scanning adjustment straight lines 122. This can reduce occurrence of the case where the correspondence relationships of the nozzles 58 in the print bars 56 are improper, without the use of the scanner. As a result, it is possible to reduce the decrease in print image quality caused by the misalignment of the nozzles 58 due to misalignment of the print bars 56 in the main scanning direction while avoiding the use of the scanner for adjustment of the misalignment of the nozzles 58.

Note that, in the test pattern 101 of the print bar sub-scanning adjustment processing, the print bar sub-scanning reference straight lines 102 and the print bar sub-scanning adjustment straight lines 103 may partially overlap one another in the main scanning direction. Moreover, the print bar sub-scanning reference straight lines 103 printed by the different print bars 56 may partially overlap one another in the main scanning direction.

Moreover, the print bar main scanning reference straight lines 121 and the print bar main scanning adjustment straight lines 122 in the print bar main scanning adjustment processing may partially overlap one another in the sub-scanning direction. Moreover, the print bar main scanning adjustment straight lines 122 printed by the different print bars 56 may partially overlap one another in the sub-scanning direction.

In the print bar sub-scanning adjustment processing of the aforementioned embodiment, there is used the test pattern 101 in which the print bar sub-scanning reference straight lines 102 and the print bar sub-scanning adjustment straight lines 103 corresponding to the respective timing adjustment values Tb are provided in one to one correspondence. However, it is possible to use a test pattern in which multiple print bar sub-scanning adjustment straight lines corresponding to the respective timing adjustment values Tb are printed for one print bar sub-scanning reference straight line as in the test pattern 81 of FIG. 7 used in the print head sub-scanning adjustment processing.

In the aforementioned embodiment, the configuration in which each print bar 56 has multiple print heads 57 is described. However, each print bar 56 may have one print head covering the entire width of the web W. In this case, in the print adjustment operation, the print head sub-scanning adjustment processing and the seam portion adjustment processing are omitted and the print bar sub-scanning adjustment processing and the print bar main scanning adjustment processing are performed.

The present invention is not limited to the aforementioned embodiment as it is and can be embodied in an implementation stage with constituent elements modified within a scope not departing from the spirit of the invention. Moreover, various inventions can be formed by appropriate combinations of multiple components disclosed in the aforementioned embodiment. For example, some of the components described in the embodiment can be omitted.

The entire contents of Japanese Patent Application No. 2017-060564 (filed on Mar. 27, 2017) are incorporated herein by reference.

The invention claimed is:

1. An inkjet printer comprising:

print heads arranged in a zigzag manner in a main scanning direction, each of the print heads including nozzles arranged in the main scanning direction and configured to eject ink from the nozzles to a print medium conveyed in a sub-scanning direction orthogonal to the main scanning direction; and a controller configured to control the print heads, wherein the controller is configured to control the print heads to print a test pattern on the print medium, the test pattern including: a single head reference straight line extending in the main scanning direction and printed by a reference print head of the print heads; and head adjustment straight lines extending in the main scanning direction and printed with respect to the single head reference straight line by each of non-reference print heads of the print heads other than the reference print head at timings corresponding to timing adjustment values, and in response to input of information specifying the head adjustment straight line with a smallest print misalignment amount in the sub-scanning direction with respect to the single head reference straight line for each of the non-reference print heads, determine, for each of the non-reference print heads, the timing adjustment value corresponding to the head adjustment straight line specified by the input information as an adjustment value of an ink ejection timing in the non-reference print head in normal printing.

2. The inkjet printer according to claim 1, wherein a first print head and a second print head adjacent to each other of the print heads are arranged to partially overlap each other in the main scanning direction in an overlap region, and the controller is configured to control the first print head and the second print head to print a first seam portion adjustment straight line extending in the main scanning direction on the print medium by using a specified number of the nozzles from an end of the first print head on a side of the overlap region and print a second seam portion adjustment straight line extending in the main scanning direction, at a same position as or a position shifted from the first seam portion adjustment straight line in the sub-scanning direction, on the print medium by using the specified number of the nozzles from an end of the second print head on a side of the overlap region, then, control the first print head and the second print head to repeat an operation a specified number of times while controlling the first print head and the second print head alternately to reduce a number of nozzles to be used by one from the side of the overlap region each time, the operation being an operation in which the first print head prints the first seam portion adjustment straight line on the print medium and the second print head prints the second seam portion adjustment straight line at a same position as or a position shifted from the first seam portion adjustment straight line in the sub-scanning direction on the print medium, and in response to input of information specifying a combination of the first seam portion adjustment straight line and the second seam portion adjustment straight line which has no gap between the first seam portion adjustment straight line and the second seam portion adjustment straight line in the main scanning direction and which has a smallest overlapping portion between the first seam portion adjustment straight line and the second seam portion adjustment straight line among combinations of the first seam portion adjustment straight lines and the second seam portion adjustment straight lines corresponding to combinations of the nozzles used in the first print head and the second print head, determine the nozzles used in the first print head and the second print head in the overlap region in printing of the combination specified by the input information as nozzles to be used in the overlap region in the normal printing.

3. The inkjet printer according to claim 1, further comprising print bars arranged side by side in the sub-scanning direction, each of the print bars including the print heads arranged in a zigzag manner in the main scanning direction, wherein the controller is configured to control the print bars to print a test pattern on the print medium, the test pattern including: a print bar sub-scanning reference straight line extending in the main scanning direction and printed by a sub-scanning reference print bar of the print bars; and print bar sub-scanning adjustment straight lines extending in the main scanning direction and printed by each of sub-scanning non-reference print bars of the print bars other than the sub-scanning reference print bar at timings corresponding to timing adjustment values, at least portions of the print bar sub-scanning adjustment straight lines not overlapping the print bar sub-scanning reference straight line in the main scanning direction, and in response to input of information specifying the print bar sub-scanning adjustment straight line with a smallest print misalignment amount in the sub-scanning direction with respect to the print bar sub-scanning reference straight line for each of the sub-scanning non-reference print bars, determine, for each of the sub-scanning non-reference print bars, the timing adjustment value corresponding to the print bar sub-scanning adjustment straight line specified by the input information as the adjustment value of the ink ejection timing in the sub-scanning non-reference print bar in the normal printing.

4. The inkjet printer according to claim 3, wherein the controller is configured to control the print bars to print position determination straight lines extending in the sub-scanning direction, respectively, on the print medium by using the nozzles located at a same position from one side in the main scanning direction in the print bars, in response to input of information specifying the position determination straight line printed nearest to the other side of the print bar in the main scanning direction, set the print bar having printed the position determination straight line specified by the input information as a main scanning reference print bar, control the print bars to print a print bar main scanning reference straight line extending in the sub-scanning direction on the print medium by using a reference nozzle of the set main scanning reference print bar and to print bar main scanning adjustment straight lines extending in the sub-scanning direction on the print medium by using the nozzles of main scanning non-reference print bars of the print bars other than the main scanning reference print bar, the nozzles being located at a same position as the reference nozzle from the one side in the main scanning direction in the main scanning non-reference print bars, at least portion of each of the print bar main scanning adjustment straight lines not overlapping the print bar main scanning reference straight line in the sub-scanning direction, then, control the print bars to repeat an operation a specified number of times, while controlling each of the main scanning non-reference print bars to shift a nozzle to be used to print the print bar main scanning adjustment straight line to a next one on the other side in the main scanning direction in the main scanning non-reference print bars each time, the operation being an operation in which the main scanning reference print bar prints the print bar main scanning reference straight line on the print medium by using the reference nozzle and each of the main scanning non-reference print bars prints the print bar main scanning adjustment straight line on the print medium with at least portion of the print bar main scanning adjustment straight line not overlapping the print bar main scanning reference straight line in the sub-scanning direction, and in response to input of information specifying the print bar main scanning adjustment straight line with a smallest print misalignment amount in the main scanning direction with respect to the print bar main scanning reference straight line for each of the main scanning non-reference print bars, determine, for each of the main scanning non-reference print bars, a correspondence relationship of the nozzles between the main scanning reference print bar and each of the main scanning non-reference print bars in the normal printing to be a relationship in which the nozzle used to print the print bar main scanning adjustment straight line specified by the input information and the reference nozzle of the main scanning reference print bar are in charge of a same pixel in the main scanning direction.

5. An inkjet printer comprising:

print heads arranged in a zigzag manner in a main scanning direction, each of the print heads including nozzles arranged in the main scanning direction and configured to eject ink from the nozzles to a print medium conveyed in a sub-scanning direction orthogonal to the main scanning direction; and a controller configured to control the print heads, wherein a first print head and a second print head adjacent to each other of the print heads are arranged to partially overlap each other in the main scanning direction in an overlap region, and the controller is configured to control the first print head and the second print head to print a first seam portion adjustment straight line extending in the main scanning direction on the print medium by using a specified number of the nozzles from an end of the first print head on a side of the overlap region and print a second seam portion adjustment straight line extending in the main scanning direction, at a same position as or a position shifted from the first seam portion adjustment straight line in the sub-scanning direction, on the print medium by using the specified number of the nozzles from an end of the second print head on a side of the overlap region, then, control the first print head and the second print head to repeat an operation a specified number of times while controlling the first print head and the second print head alternately to reduce a number of nozzles to be used by one from the side of the overlap region each time, the operation being an operation in which the first print head prints the first seam portion adjustment straight line on the print medium and the second print head prints the second seam portion adjustment straight line at a same position as or a position shifted from the first seam portion adjustment straight line in the sub-scanning direction on the print medium, and in response to input of information specifying a combination of the first seam portion adjustment straight line and the second seam portion adjustment straight line which has no gap between the first seam portion adjustment straight line and the second seam portion adjustment straight line in the main scanning direction and which has a smallest overlapping portion between the first seam portion adjustment straight line and the second seam portion adjustment straight line among combinations of the first seam portion adjustment straight lines and the second seam portion adjustment straight lines corresponding to combinations of the nozzles used in the first print head and the second print head, determine the nozzles used in the first print head and the second print head in the overlap region in printing of the combination specified by the input information as nozzles to be used in the overlap region in normal printing.

6. An inkjet printer comprising:

print bars arranged side by side in a sub-scanning direction orthogonal to a main scanning direction, each of the print bars including nozzles arranged in the main scanning direction and configured to eject ink from the nozzles to a print medium conveyed in the sub-scanning direction; and a controller configured to control the print bars, wherein the controller is configured to control the print bars to print position determination straight lines extending in the sub-scanning direction, respectively, on the print medium by using the nozzles located at a same position from one side in the main scanning direction in the print bars, in response to input of information specifying the position determination straight line printed nearest to the other side in the print bars in the main scanning direction, set the print bar having printed the position determination straight line specified by the input information as a main scanning reference print bar, control the print bars to print a print bar main scanning reference straight line extending in the sub-scanning direction on the print medium by using a reference nozzle of the set main scanning reference print bar and to print bar main scanning adjustment straight lines extending in the sub-scanning direction on the print medium by using the nozzles of main scanning non-reference print bars of the print bars other than the main scanning reference print bar, the nozzles being located at a same position as the reference nozzle from the one side in the main scanning direction in the main scanning non-reference print bars, at least portion of each of the print bar main scanning adjustment straight lines not overlapping the print bar main scanning reference straight line in the sub-scanning direction, then, control the print bars to repeat an operation a specified number of times, while controlling each of the main scanning non-reference print bars to shift a nozzle to be used to print the print bar main scanning adjustment straight line to a next one on the other side in the main scanning direction in the main scanning non-reference print bars each time, the operation being an operation in which the main scanning reference print bar prints the print bar main scanning reference straight line on the print medium by using the reference nozzle and each of the main scanning non-reference print bars prints the print bar main scanning adjustment straight line on the print medium with at least portion of the print bar main scanning adjustment straight line not overlapping the print bar main scanning reference straight line in the sub-scanning direction, and in response to input of information specifying the print bar main scanning adjustment straight line with a smallest print misalignment amount in the main scanning direction with respect to the print bar main scanning reference straight line for each of the main scanning non-reference print bars, determine, for each of the main scanning non-reference print bars, a correspondence relationship of the nozzles between the main scanning reference print bar and each of the main scanning non-reference print bars in normal printing to be a relationship in which the nozzle used to print the print bar main scanning adjustment straight line specified by the input information and the reference nozzle of the main scanning reference print bar are in charge of a same pixel in the main scanning direction.

* * * * *